US010698349B1

(12) United States Patent
Katsumata

(10) Patent No.: US 10,698,349 B1
(45) Date of Patent: Jun. 30, 2020

(54) IMAGE FORMING APPARATUS, IMAGE FORMING METHOD, AND NON-TRANSITORY RECORDING MEDIUM CAPABLE OF CONTROLLING WHETHER OR NOT TO GENERATE HEAT FOR EACH OF A PLURALITY OF HEAT GENERATING CELLS IN A FIXING DEVICE

(71) Applicant: TOSHIBA TEC KABUSHIKI KAISHA, Shinagawa-ku, Tokyo (JP)

(72) Inventor: Satoshi Katsumata, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/565,554

(22) Filed: Sep. 10, 2019

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2042
USPC ..... 399/69
See application file for complete search history.

(56) References Cited

U.S. PATENT DOCUMENTS 8,755,727 B2 6/2014 Kosasa
9,116,479 B2 * 8/2015 Umezawa et al. ..... G03G 15/2042

* cited by examiner

*Primary Examiner* — William J Royer
(74) *Attorney, Agent, or Firm* — Amin, Turocy & Watson LLP

(57) ABSTRACT

According to one embodiment, an image forming apparatus includes a fixing device and a control unit. The fixing device forms an image represented by print data on an image forming medium by causing a part or all of a plurality of heat generating cells to generate heat, and by fixing a developer image corresponding to the print data on the surface of the image forming medium. The control unit corrects image data before correction so as to reduce the number of heat generating cells which are caused to generate heat among the plurality of heat generating cells based upon an arrangement of an image represented by the image data before correction and an arrangement of the plurality of heat generating cells, and uses image data after correction obtained by correcting the image data before correction as the print data.

20 Claims, 16 Drawing Sheets

IMAGE FORMING APPARATUS, IMAGE FORMING METHOD, AND NON-TRANSITORY RECORDING MEDIUM CAPABLE OF CONTROLLING WHETHER OR NOT TO GENERATE HEAT FOR EACH OF A PLURALITY OF HEAT GENERATING CELLS IN A FIXING DEVICE

FIELD

Embodiments described herein relate generally to an image forming apparatus, an image forming method, and a non-transitory recording medium.

BACKGROUND

In an image forming apparatus, a fixing device including a plurality of heat generating cells may be used. In such a fixing device, whether or not to generate heat can be controlled for each of the heat generating cells.

Generally, power saving is desired in the image forming apparatus. Further power saving is also desired in the fixing device.

DETAILED DESCRIPTION

In general, according to one embodiment, an image forming apparatus includes a fixing device and a control unit. The fixing device forms an image represented by print data on an image forming medium by causing a part or all of a plurality of heat generating cells to generate heat, and by fixing a developer image corresponding to the print data on the surface of the image forming medium. The control unit corrects image data before correction so as to reduce the number of heat generating cells which are caused to generate heat among the plurality of heat generating cells based upon an arrangement of an image represented by the image data before correction and an arrangement of the plurality of heat generating cells, and uses image data after correction obtained by correcting the image data before correction as the print data.

Hereinafter, an image forming apparatus, an image forming method, and a non-transitory recording medium according to an embodiment will be described with reference to the accompanying drawings.

First Embodiment

Figure 1:
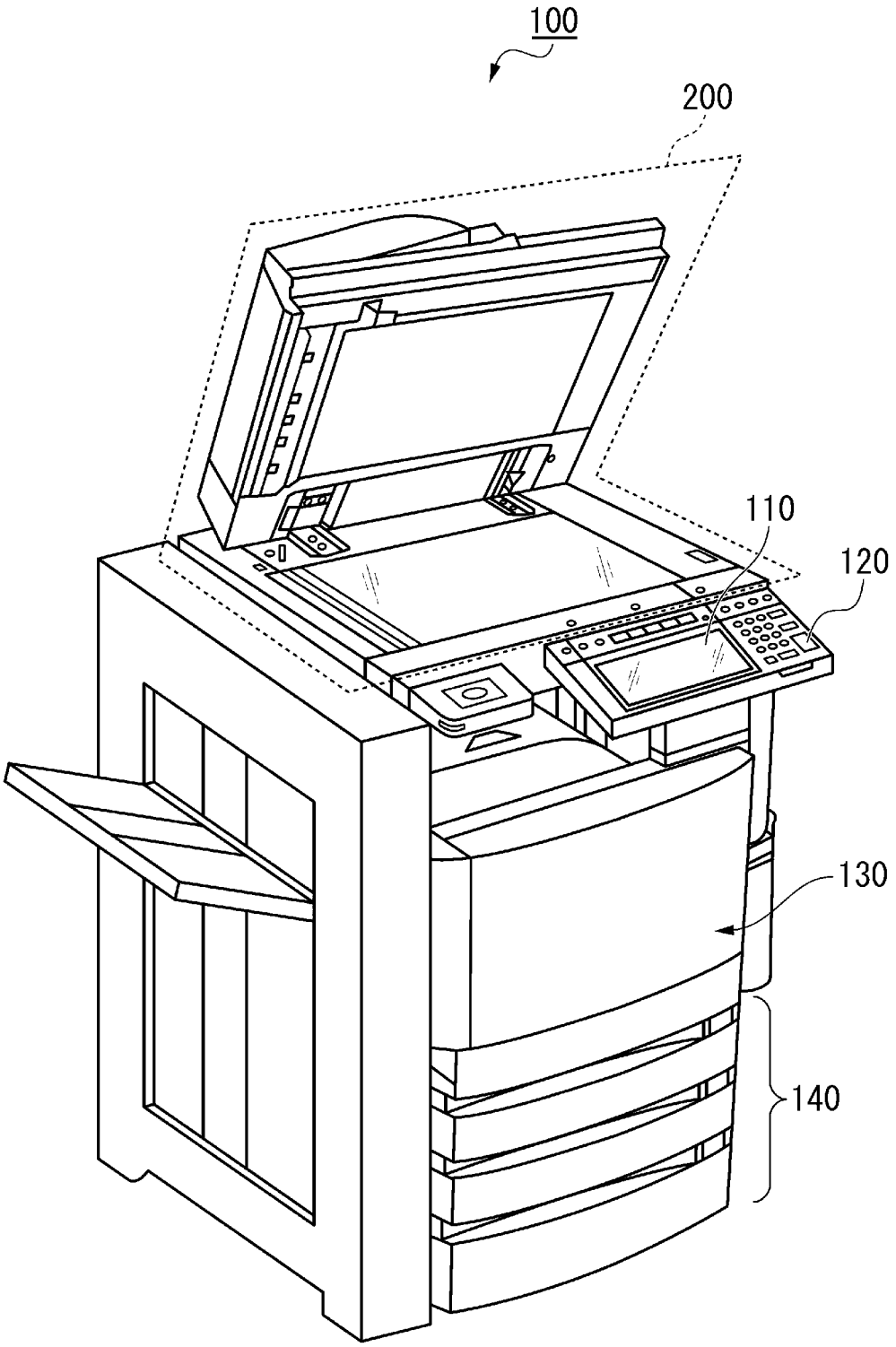
FIG. 1 is an external view illustrating an example of an overall configuration of an image forming apparatus of an embodiment.
Figure 2:
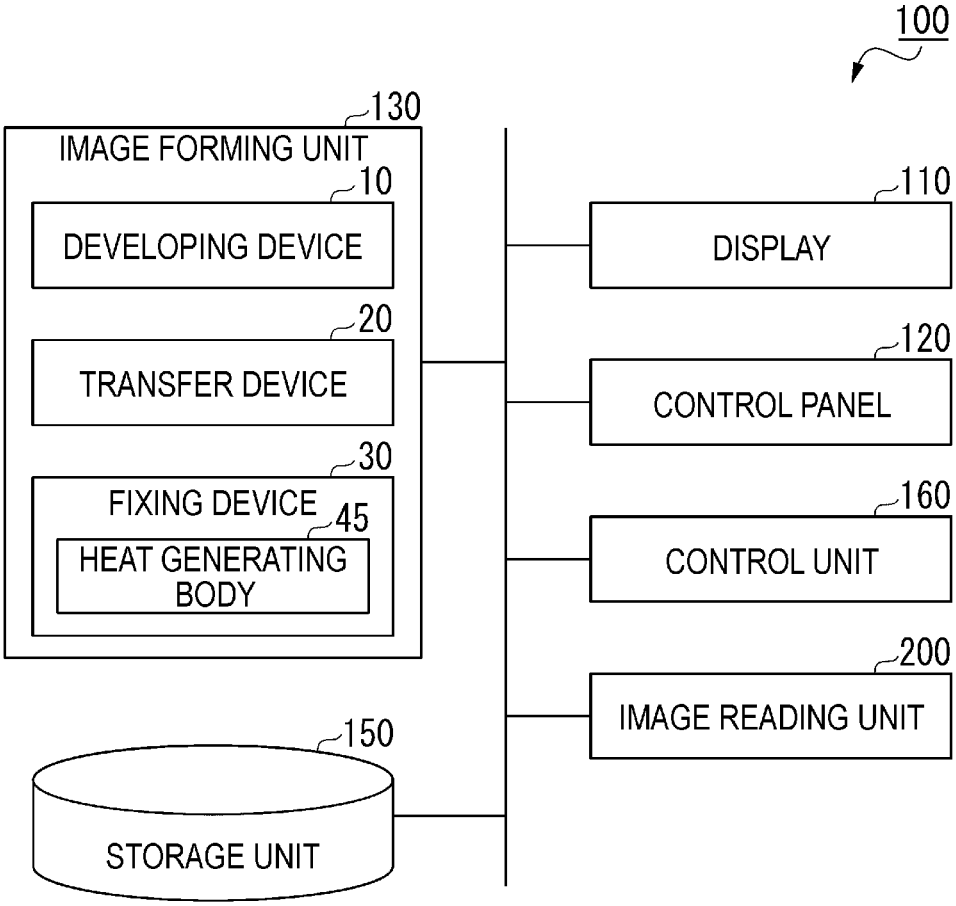
FIG. 2 is a hardware block diagram of the image forming apparatus of the embodiment.

FIG. 1 is an external view illustrating an example of an overall configuration of an image forming apparatus 100 of an embodiment. FIG. 2 is a hardware block diagram of the image forming apparatus 100 of the embodiment.

For example, the image forming apparatus 100 is a multifunction peripheral. The image forming apparatus 100 includes a display 110, a control panel 120, an image forming unit 130, a sheet storage unit 140, a storage unit 150, a control unit 160, and an image reading unit 200.

The image forming apparatus 100 forms an image on a sheet by using a developer such as toner. The developer is fixed on the sheet by heating. For example, the sheet is paper or label paper. The sheet may be any object as long as the image forming apparatus 100 can form the image on the surface thereof.

The display 110 is an image display apparatus such as a liquid crystal display and an organic EL (Electro Luminescence) display. The display 110 displays various information related to the image forming apparatus 100.

The control panel 120 includes a plurality of buttons. The control panel 120 receives an operation of a user. The control panel 120 outputs a signal corresponding to the operation performed by the user to the control unit 160. Further, the display 110 and the control panel 120 may be configured as an integrated touch panel.

The image forming unit 130 forms an image on a sheet based upon image information generated by the image reading unit 200 or image information received via a communication path. The image forming unit 130 includes a developing device 10, a transfer device 20, and a fixing device 30. The fixing device 30 includes a heat generating body 45.

For example, the image forming unit 130 forms the image thereon by the following processing. The developing device 10 of the image forming unit 130 forms an electrostatic latent image on a photosensitive drum based upon the image information. The developing device 10 of the image forming unit 130 forms a visible image (a developer image) by attaching the developer to the electrostatic latent image. A specific example of the developer is toner. As examples of the toner, there are decoloring toner, non-decoloring toner, and decorative toner. Further, the non-decoloring toner is normal toner.

The transfer device 20 of the image forming unit 130 transfers the visible image onto the sheet. The fixing device 30 of the image forming unit 130 fixes the visible image onto the sheet by heating and pressurizing the sheet. Further, the sheet on which the image is formed may be a sheet stored in the sheet storage unit 140 or may be a manually inserted sheet.

The sheet storage unit 140 stores a sheet to be used for image formation in the image forming unit 130.

The storage unit 150 is configured by using a storage apparatus such as a magnetic hard disk apparatus or a semiconductor storage apparatus. The storage unit 150 stores data required when the image forming apparatus 100 operates. The storage unit 150 may temporarily store data of the image to be formed in the image forming apparatus 100.

The control unit 160 is configured by using a processor such as a CPU (Central Processing Unit) and a memory. The control unit 160 reads and executes a program stored in advance in the storage unit 150. The control unit 160 controls an operation of each device provided in the image forming apparatus 100.

The control unit 160 controls power supplied to the heat generating body 45.

The image reading unit 200 reads image information to be read as light and darkness of light. The image reading unit 200 records the read image information. The recorded image information may be transmitted to another information processing apparatus via a network. The recorded image information may be formed on the sheet as an image by the image forming unit 130. The image reading unit 200 may be provided with an ADF (Auto Document Feeder).

Figure 3:
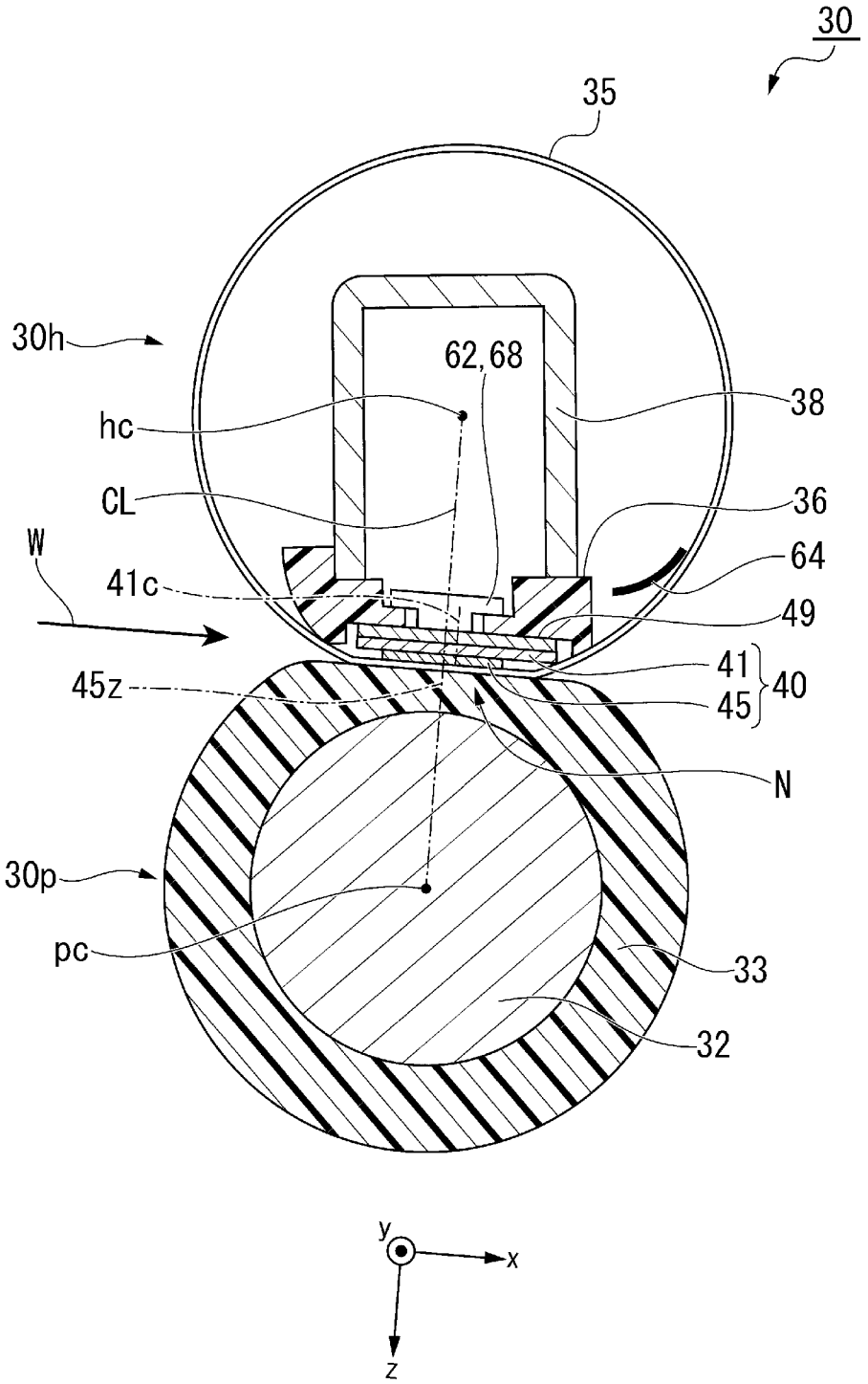
FIG. 3 is a front cross-sectional view of a fixing device of an embodiment.

FIG. 3 is a front cross-sectional view of the fixing device 30 of the embodiment. The fixing device 30 of the embodiment includes a pressure roller 30*p* and a film unit 30*h*.

In FIG. 3, an xyz orthogonal coordinate system is shown for convenience of description.

The pressure roller 30*p* can press a surface of the film unit 30*h* and can be rotationally driven. The pressure roller 30*p* forms a nip N with the film unit 30*h* when the surface thereof is pressed against the film unit 30*h*. The pressure roller 30*p* pressurizes the visible image of the sheet entering the nip N. When the pressure roller 30*p* is rotationally driven, the pressure roller 30*p* conveys the sheet according to the rotation thereof. For example, the pressure roller 30*p* includes a core metal 32, an elastic layer 33, and a release layer (not illustrated).

The core metal 32 is formed in a cylindrical shape by a metallic material such as stainless steel. Opposite end parts in the axial direction of the core metal 32 are rotatably supported. The core metal 32 is rotationally driven by a motor (not illustrated). The core metal 32 abuts on a cam member (not illustrated).

The elastic layer 33 is formed of an elastic material such as silicone rubber. The elastic layer 33 is formed on the outer peripheral surface of the core metal 32 with a constant thickness. The release layer (not illustrated) is formed on the outer peripheral surface of the elastic layer 33. The release layer is formed of a resin material such as PFA (tetrafluoroethylene-perfluoroalkyl vinyl ether copolymer).

The pressure roller 30*p* is rotationally driven by a motor, thereby rotating on its own axis. When the pressure roller 30*p* rotates on its own axis in a state where the nip N is formed, a cylindrical film (a thin film) 35 of the film unit 30*h* is driven and rotated. The pressure roller 30*p* conveys the sheet in a conveyance direction W by rotating on its own axis in a state where the sheet is disposed in the nip N.

The film unit 30*h* heats the visible image of the sheet entering the nip N. The film unit 30*h* includes the cylindrical film (a cylindrical body) 35, a heater 40, a heat transfer member 49, a support member 36, a stay 38, a heater thermometer 62, a thermostat 68, and a film thermometer 64.

Further, the heater 40 may be referred to as a heater unit.

The cylindrical film 35 is formed in a cylindrical shape. The cylindrical film 35 includes abase layer, an elastic layer, and a release layer in order from the inner peripheral side. The base layer is formed in a cylindrical shape by a material such as nickel (Ni). The elastic layers are laminated and disposed on the outer peripheral surface of the base layer. The elastic layer is formed of an elastic material such as silicone rubber. The release layer is laminated and disposed on the outer peripheral surface of the elastic layer. The release layer is formed of a material such as a PFA resin.

The heater 40 includes a substrate 41 and the heat generating body 45. The substrate 41 is a heat generating body substrate. The substrate 41 is formed of a metallic material such as stainless steel or nickel, or a ceramic material such as aluminum nitride. The substrate 41 is formed in a long and thin rectangular plate shape. The substrate 41 is disposed on the inside in the radial direction of the cylindrical film 35. The substrate 41 has the axial direction of the cylindrical film 35 as the longitudinal direction.

The heat generating body 45 is formed on the surface of the substrate 41. The heat generating body 45 includes a plurality of heat generating cells. The plurality of heat generating cells are arranged in the main scanning direction.

The heat generating body 45 is formed by using a heat generating resistor such as a silver and palladium alloy. An energization amount supplied to the heat generating body 45 is controlled by the control unit 160.

As illustrated in FIG. 3, the heater 40 is disposed inside the cylindrical film 35. A lubricant (not illustrated) is applied on the inner peripheral surface of the cylindrical film 35. The heater 40 comes into contact with the inner peripheral surface of the cylindrical film 35 via the lubricant. When the heater 40 generates heat, the viscosity of the lubricant deteriorates. Accordingly, the slidability between the heater 40 and the cylindrical film 35 is secured. As a result, the cylindrical film 35 is a belt-shaped thin film sliding on the surface of the heater 40 while being in contact with the heater 40 on one surface.

The support member 36 is formed of a resin material such as a liquid crystal polymer. The support member 36 supports the heater 40. The support member 36 supports the inner peripheral surface of the cylindrical film 35 at opposite end parts of the heater 40.

The stay 38 is formed of a steel plate material. For example, the cross section of the stay 38 may be U-shaped. The stay 38 is mounted so as to close the U-shaped opening unit with the support member 36. Opposite end parts of the stay 38 are fixed to a housing of the image forming apparatus 100. Accordingly, the film unit 30*h* is supported by the image forming apparatus 100.

The heater thermometer 62 measures the temperature of the heater 40. The heater thermometer 62 is disposed near the heater 40.

The thermostat 68 is disposed near the heater 40 in the same manner as the heater thermometer 62. The thermostat 68 cuts off the energization to the heat generating body 45 when the measured temperature of the heater 40 exceeds a predetermined temperature.

Further, FIG. 3 illustrates a center pc of the pressure roller 30*p*, a center hc of the film unit 30*h*, and a straight line CL connecting the center pc thereof and the center hc thereof.

Further, FIG. 3 illustrates a center 45*z* in the x direction of the heat generating body 45 and a center 41*c* in the x direction of the substrate 41.

In the image forming apparatus 100 of the embodiment, an on-demand method is used as a fixing method. In the on-demand method, power consumption in the image forming apparatus 100 can be reduced. In such an on-demand method, the film is driven by a rotating member provided with the elastic layer 33. Then, in the on-demand method, the conveyed sheet and developer are heated by the heater 40 through the film.

Hereinafter, a mode in which the control unit 160 controls the heat generation by the heat generating body 45 will be described. In the fixing device 30, heating is realized by the heat generation of the heat generating body 45.

In the embodiment, an image to be printed is referred to as a print target image in the following description. In the embodiment, the image may include any one or more of a character, a graphic, a picture, and a photograph.

Further, in the data which become the print target image, one or more of the character, the graphic, the picture, and the photograph may be identified by an application as the character, the graphic, the picture, and the photograph. As a specific example, a word processing application identifies the character. Further, as a specific example, the graphic is identified by the drawing application.

Further, in the data which become the print target image, the character, the graphic, the picture, and the photograph may be identified by an application as a simple set of points. As a specific example, in an application handling bit map data, the pixel values of each of a plurality of points are identified, but are not identified as the character.

Figure 4:
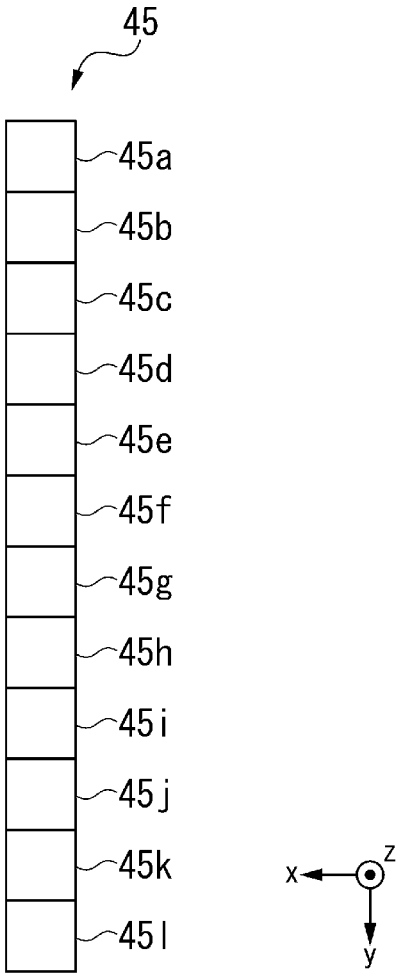
FIG. 4 is a diagram illustrating a plurality of heat generating cells of a heat generating body of an embodiment.

FIG. 4 is a diagram illustrating a plurality of heat generating cells 45*a* to 451 of the heat generating body 45 of the embodiment.

In the example of FIG. 4, the heat generating body 45 has a plurality of heat generating cells 45*a* to 451. The plurality of heat generating cells 45*a* to 451 are disposed to be arranged in a straight line.

Here, each of the heat generating cells 45*a* to 451 is a heat generating unit of the minimum unit capable of controlling whether or not heat is generated by the control unit 160. In the embodiment, with respect to each of the heat generating cells 45*a* to 451 arranged in the straight line, a width in the direction of the straight line will be referred to as a width of the heat generating cell in the following description. In the embodiment, the widths of the respective heat generating cells 45*a* to 451 are equal. In the embodiment, a region where heat is generated by each of the plurality of heat generating cells 45*a* to 451 will be referred as a heat generating region in the following description.

In the example of FIG. 4, the number of the plurality of heat generating cells 45*a* to 451 is twelve pieces, but is not limited thereto. The number of the plurality of heat generating cells 45*a* to 451 may be any number of two or more.

For example, a thermal print head (TPH) may be used as the heat generating body 45. In this case, in the example, the thermal print head has a structure in which the plurality of heat generating cells is provided in the main scanning direction. In this case, the control unit 160 controls the heat generating cell which is caused to generate heat according to the print target image.

The control unit 160 controls whether or not heat is generated for each of the plurality of heat generating cells 45*a* to 451.

Further, the control unit 160 corrects an arrangement of the print target image based upon an arrangement of the plurality of heat generating cells 45*a* to 451. Specifically, the control unit 160 corrects the arrangement of the print target image so that the number of heat generating cells which are caused to generate heat among the plurality of heat generating cells 45*a* to 451 becomes small as compared with that before correction.

Whether or not the print target image is corrected in the image forming apparatus 100 can be set by a user. The control unit 160 switches between setting for correcting the print target image and setting for not correcting the print target image according to a predetermined operation performed on the control panel 120 by the user. The contents of the setting are stored in the storage unit 150. The control unit 160 reads and uses the contents of the setting stored in the storage unit 150.

Further, whether or not the print target image is corrected in the image forming apparatus 100 may be switched according to a predetermined number of sheets for printing. When the predetermined number of sheets for printing exceeds a predetermined threshold value, the control unit 160 performs the setting for correcting the print target image. On the other hand, when the predetermined number of sheets for printing is equal to or less than the predetermined threshold value, the control unit 160 performs the setting for not correcting the print target image.

Here, the predetermined number of sheets for printing may be the total number of sheets to be printed, or may be another number. Specifically, the predetermined number of sheets for printing may be the number of sheets of the original documents to be printed. Further, the predetermined number of sheets for printing may be the number of copies to be printed. Further, the predetermined number of sheets for printing may be the number of results obtained by multiplying the number of sheets of the original documents to be printed by the number of copies to be printed. The result of this multiplication is the total number of sheets to be printed.

Figure 5:
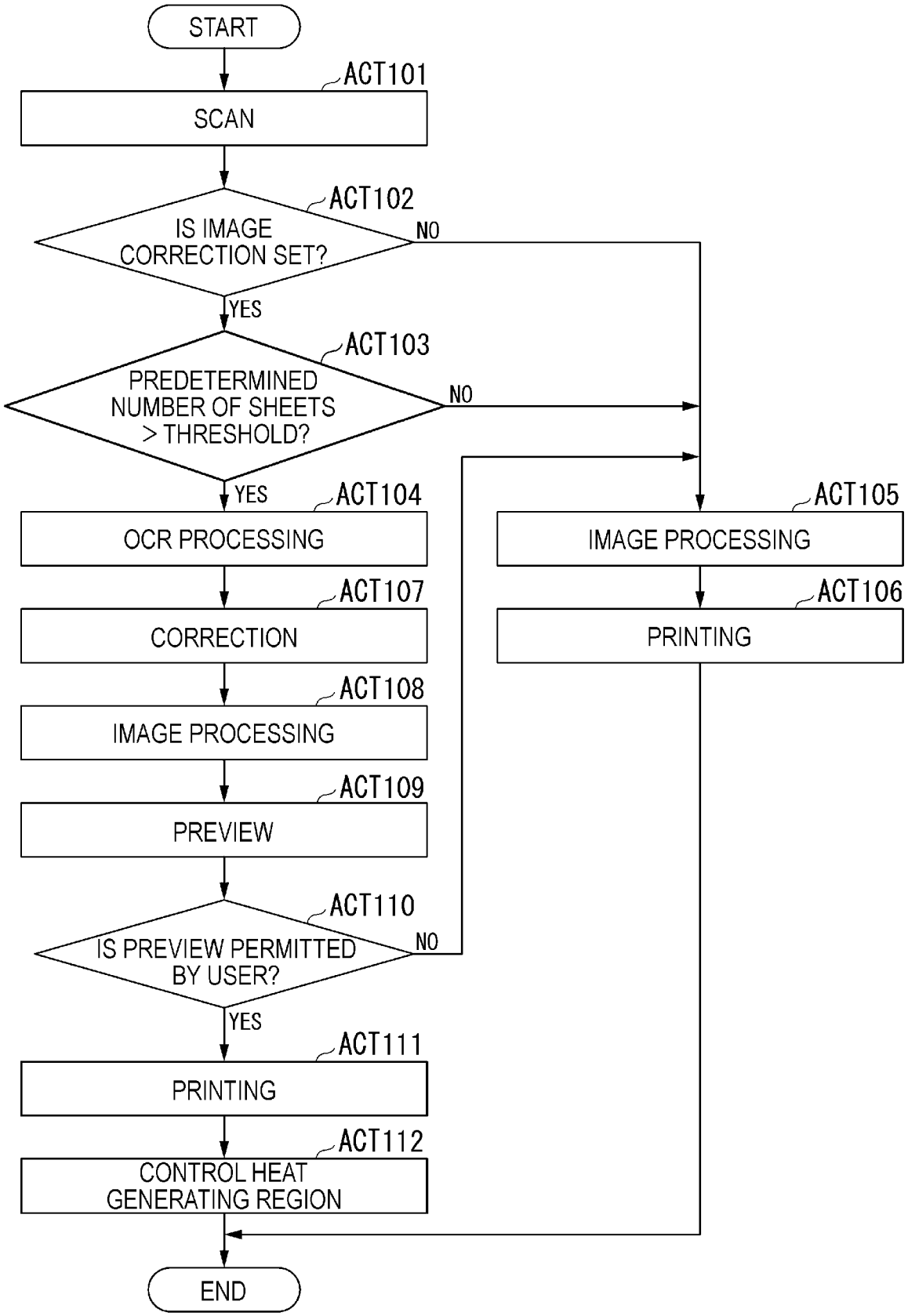
FIG. 5 is a diagram illustrating a specific example of a flow of an operation of the image forming apparatus of the embodiment.

FIG. 5 is a diagram illustrating a specific example of a flow of an operation of the image forming apparatus 100 of the embodiment.

An image is formed on an original document to be printed. In this example, the content of the image is formed of a plurality of characters.

In the image forming apparatus 100, the image reading unit 200 scans the image of the original document to be printed, thereby reading the image thereof (ACT 101). In the image forming apparatus 100, the number of copies for printing is set by a user in scanning. Further, in the image forming apparatus 100, the number of sheets of original documents is detected by scanning.

Next, the control unit 160 determines whether or not performing the correction of the print target image is set by the user (ACT 102).

In this case, in the image forming apparatus 100, it is possible for the user to optionally set in advance whether or not to perform the correction of the print target image.

When determining that performing the correction of the print target image is set by the user (ACT 102: YES), the control unit 160 performs the processing of ACT 103. In the processing of ACT 103, the control unit 160 determines whether or not the predetermined number of sheets for printing exceeds the predetermined threshold value (ACT 103).

Further, instead of the processing of determining whether or not the predetermined number of sheets for printing exceeds the predetermined threshold value, the processing of determining whether or not the predetermined number of sheets for printing is equal to or greater than the predetermined threshold value may be used.

When determining that the predetermined number of sheets for printing exceeds the predetermined threshold value (ACT 103: YES), the control unit 160 performs the processing of ACT 104. In the processing of ACT 104, the control unit 160 performs the processing of OCR (Optical Character Recognition) on the read image (ACT 104).

Here, in the OCR processing, character information is recognized and read from the print target image. In the data as a result of performing the OCR processing, a character included in the image formed on the original document is represented as a digital character code. In the example, the data are formed of a plurality of character codes representing a plurality of characters.

Thereafter, with respect to the data as a result of performing the OCR processing, the control unit 160 corrects the aforementioned data so that the number of heat generating cells which are caused to generate heat among the plurality of heat generating cells 45*a* to 451 of the heat generating body 45 becomes small as compared with that before correction (ACT 107). In this correction, one or more of a size of the character, a space between the characters, and a line space between the characters included in the data are appropriately adjusted.

Further, in the processing of ACT 107, the control unit 160 does not correct the data when determining that the number of heat generating cells 45*a* to 451 which are caused to generate heat does not decrease even though the data as a result of performing the OCR processing are corrected.

Thereafter, the control unit 160 performs image processing on the data after correction (ACT 108). The image processing is processing for printing the content of the data after correction as an image.

Thereafter, the control unit 160 displays the print target image on the display 110 as a preview (ACT 109). In this case, the user instructs the image forming apparatus 100 to determine whether or not to permit the print content of the preview by performing the predetermined operation on the control panel 120.

Here, in this example, since the image forming apparatus 100 can correct the print target image, the preview of printing is displayed to the user before the print target image after correction is printed. The user can confirm the arrangement of the print target image in the printing result by the preview.

The control unit 160 determines whether or not the print content of the preview is permitted by the user based upon the predetermined operation performed on the control panel 120 by the user (ACT 110).

When determining that the print content of the preview is permitted by the user (ACT 110: YES), the control unit 160 performs control so as to perform printing with the print content (ACT 111). In this case, the control unit 160 performs control so that only the heat generating cell over which the print target image exists is caused to generate heat among the plurality of heat generating cells 45*a* to 451 of the fixing device 30 (ACT 112). Next, the control unit 160 terminates the processing of this flow.

Here, in the processing of ACT 102, when determining that performing the correction of the print target image is not set by the user (ACT 102:NO), the control unit 160 proceeds to the processing of ACT 105.

Further, in the processing of ACT 103, when determining that the predetermined number of sheets for printing is equal to or less than the predetermined threshold value (ACT 103:NO), the control unit 160 proceeds to the processing of ACT 105.

Further, in the processing of ACT 110, when determining that print content of the preview is not permitted by the user (ACT 110:NO), the control unit 160 proceeds to the processing of ACT 105.

In the processing of ACT 105, the control unit 160 performs image processing on the data of the uncorrected print target image (ACT 105). The image processing is processing for printing the content of the data of the uncorrected print target image as an image.

Thereafter, the control unit 160 performs control so as to print the content of the data of the uncorrected print target image (ACT 106). Next, the control unit 160 terminates the processing of this flow.

Hereinafter, a specific example of correction of the print target image will be descried.

Figure 6:
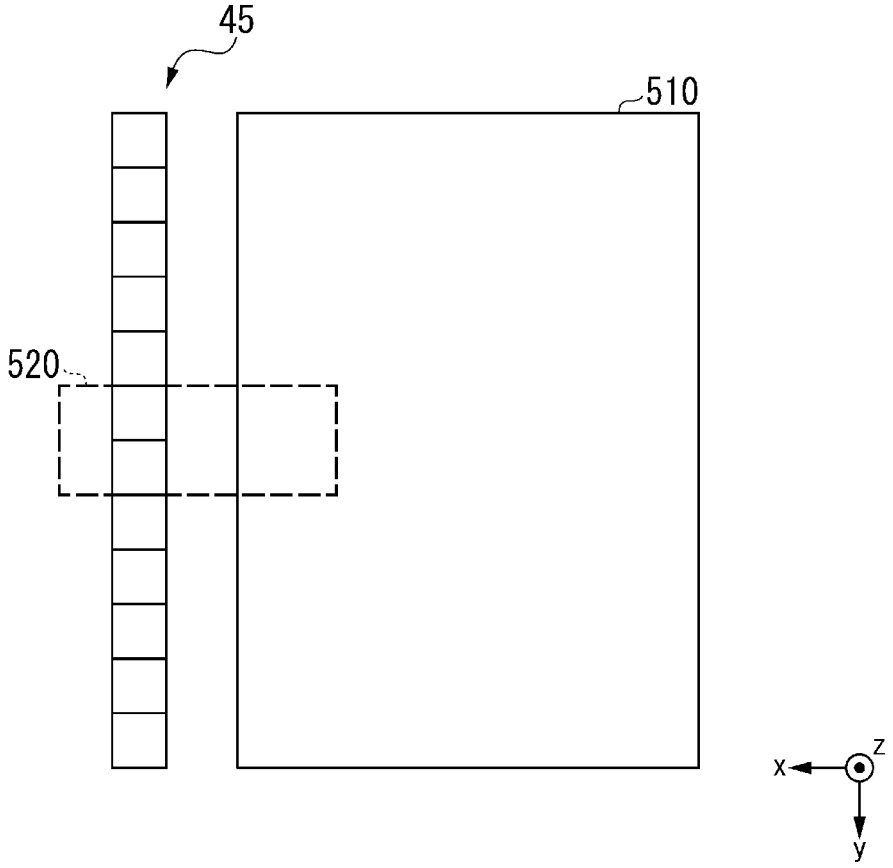
FIG. 6 is a diagram illustrating an arrangement relationship between the heat generating body and a sheet of the embodiment.

FIG. 6 is a diagram illustrating an arrangement relationship between the heat generating body 45 and a sheet 510 of the embodiment.

FIG. 6 illustrates the same xyz orthogonal coordinate system as that of FIG. 3 for convenience of description.

For convenience of description, it is described that the heat generating body 45 and the sheet 510 are on an xy plane.

The heat generating body 45 has a rectangular shape when viewed in the direction parallel to a z-axis on the xy plane. In the heat generating body 45, the plurality of heat generating cells 45*a* to 451 are arranged in the direction parallel to a y-axis.

The sheet 510 has a rectangular shape when viewed in the direction parallel to the z-axis on the xy plane. In the sheet 510, the longer side of the rectangular shape is disposed in parallel to the y-axis. Further, in the sheet 510, the shorter side of the rectangular shape is disposed in parallel to an x-axis. Further, in the embodiment, the longer side thereof is referred to as a long side and the shorter side thereof is referred to as a short side for convenience of description.

In comparison with the length of the long side of the sheet 510, the length of the side parallel to the y-axis of the heat generating body 45 is the same or longer.

The sheet 510 is moved in the direction parallel to the x-axis. That is, the advancing direction of the sheet 510 is a direction parallel to the x-axis.

In FIG. 6, a region 520 including a part of the plurality of heat generating cells 45*a* to 451 of the heat generating body 45 is indicated by being surrounded with a dotted line.

A specific example of printing an image of a sheet will be described with reference to FIGS. 7 and 8.

Figure 7:
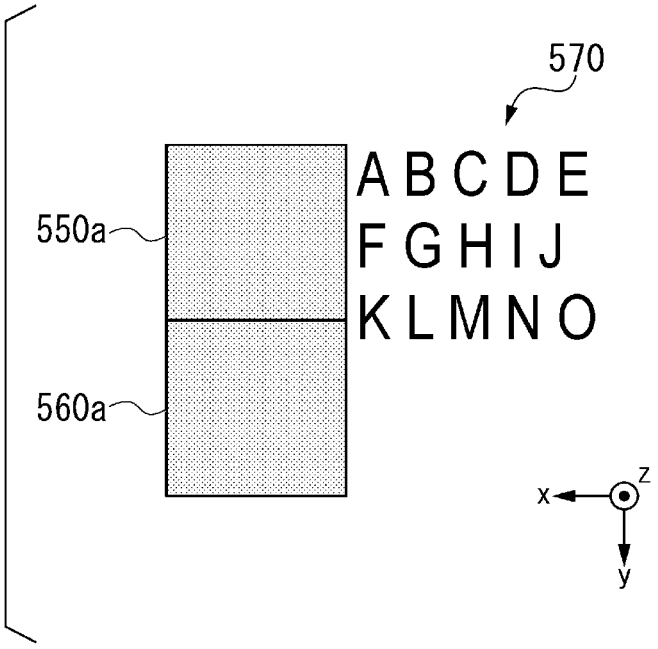
FIG. 7 is a diagram illustrating an arrangement relationship between a plurality of heat generating cells and a print target image before correction according to a first specific example of the embodiment.
Figure 8:
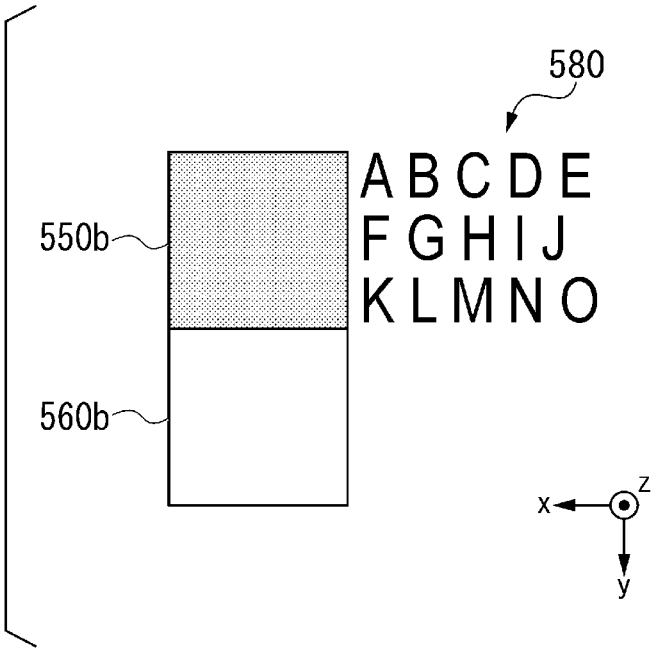
FIG. 8 is a diagram illustrating an arrangement relationship between a plurality of heat generating cells and a print target image after correction according to the first specific example of the embodiment.

Each of FIGS. 7 and 8 illustrates the same xyz orthogonal coordinate system as that of FIG. 1 for convenience of description.

FIG. 7 is a diagram illustrating an arrangement relationship between a plurality of heat generating cells 550*a* and 560*a* and a print target image before correction 570 according to a first specific example of the embodiment.

The heat generating cells 550*a* and 560*a* are heat generating cells included in the region 520 illustrated in FIG. 6.

The print target image 570 is data as a result of performing the OCR processing. The data are data before correction. The data include a plurality of pieces of character information.

In the case of FIG. 7, the print target image 570 extends over both the heat generating cell 550*a* and the heat generating cell 560*a* in the direction of the y-axis. Therefore, the control unit 160 performs control so that both the heat generating cell 550*a* and the heat generating cell 560*a* are caused to generate heat, and performs control so as to print the print target image 570. That is, the control unit 160 performs the control so that a heat generating region corresponding to both the heat generating cell 550*a* and the heat generating cell 560*a* is caused to generate heat.

FIG. 8 is a diagram illustrating an arrangement relationship between a plurality of heat generating cells 550*b* and 560*b* and a print target image 580 after correction according to the first specific example of the embodiment.

The heat generating cell 550*b* is the same as the heat generating cell 550*a*. The heat generating cell 560*b* is the same as the heat generating cell 560*a*.

The print target image 580 is data after correction. The data include a plurality of pieces of character information.

In the case of FIG. 8, the print target image 580 exists only in a region corresponding to one heat generating cell 550*b* out of the heat generating cell 550*b* and the heat generating cell 560*b* in the direction of the y-axis. Therefore, the control unit 160 performs control so that only the heat generating cell 550*b* out of the heat generating cell 550*b* and the heat generating cell 560*b* is caused to generate heat, and performs control so as to print the print target image 580. That is, the control unit 160 performs the control so that only the heat generating region corresponding to the heat generating cell 550*b* out of the heat generating cell 550*b* and the heat generating cell 560*b* is caused to generate heat.

In the examples of FIGS. 7 and 8, different colors are respectively applied to the heat generating cells 550*a*, 560*a*, and 550*b* which are caused to generate heat and the heat generating cell 560*b* which is not caused to generate heat.

As described above, the control unit 160 corrects the print target image, so that the number of heat generating cells required to generate heat after correction can be reduced as compared with that before correction. In this example, the control unit 160 corrects the print target image so as to minimize the number of heat generating cells required to generate heat. In this example, the control unit 160 converts the print target image into character information, and then corrects the print target image based upon the converted character information. In this example, in the image forming apparatus 100, the number of heat generating cells required to generate heat is reduced, thereby making it possible to reduce power required for generating heat of the heat generating cells.

In this example, when the print content exists across the plurality of adjacent heat generating cells, the control unit 160 adjusts the arrangement of the character information so that the print target image is arranged in fewer heat generating cells. Accordingly, in the image forming apparatus 100, it is possible to print the print target image in the minimum heat generating region to the possible extent.

Further, in the image forming apparatus 100, an adjustment range such as a size of the character, a space between the characters or a line space between the characters may be set in advance. Thus, the control unit 160 does not excessively adjust the arrangement of the character information, and can reduce a change in the layout of the print target image. For example, it is desirable that the layout of the print target image is changed to the minimum. The content of the setting may be stored in the storage unit 150. The control unit 160 reads and uses the content of the setting stored in the storage unit 150.

A specific example of printing an image of a sheet will be described with reference to FIGS. 9 and 10.

Figure 9:
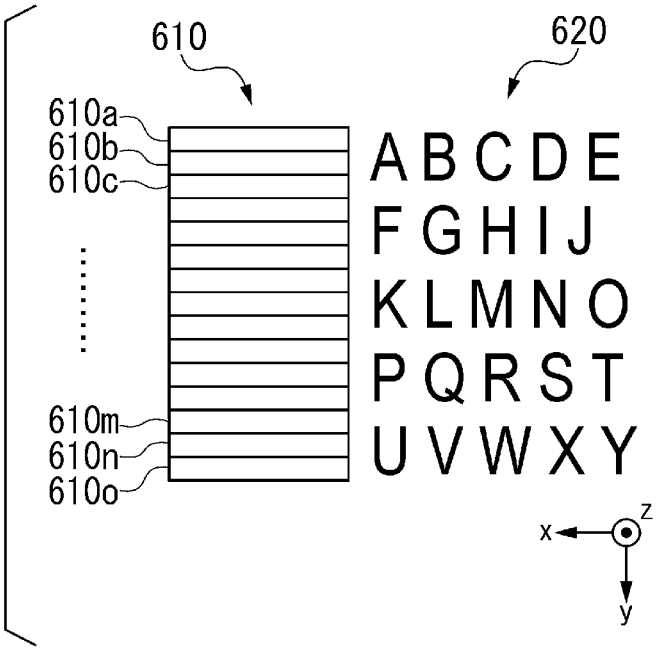
FIG. 9 is a diagram illustrating an arrangement relationship between a plurality of heat generating cells and a print target image before correction according to a second specific example of the embodiment.
Figure 10:
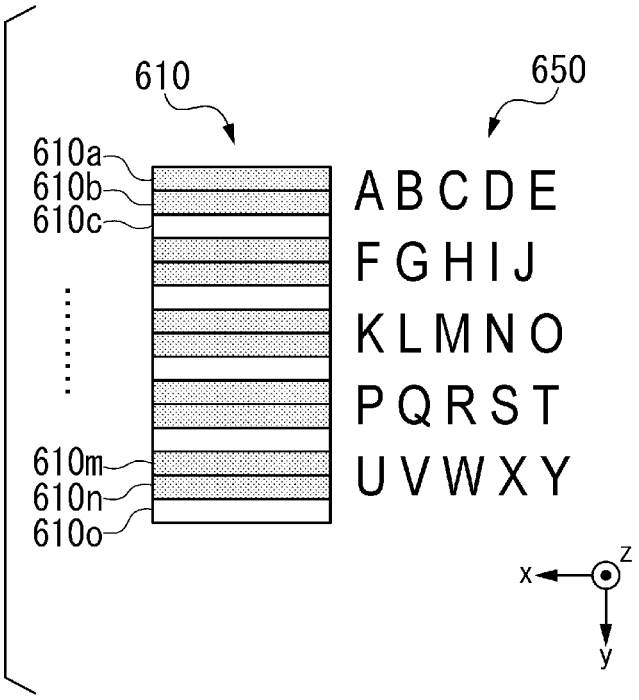
FIG. 10 is a diagram illustrating an arrangement relationship between a plurality of heat generating cells and a print target image after correction according to the second specific example of the embodiment.

Each of FIGS. 9 and 10 illustrates the same xyz orthogonal coordinate system as that of FIG. 3 for convenience of description.

FIG. 9 is a diagram illustrating an arrangement relationship between a plurality of heat generating cells 610*a* to 610*o* and a print target image 620 before correction according to a second specific example of the embodiment.

In this example, a case where a heat generating body 610 includes fifteen pieces of the heat generating cells 610*a* to 610*o* is shown.

The print target image 620 is data as a result of performing the OCR processing. The data are data before correction. The data include a plurality of pieces of character information.

In the case of FIG. 9, the print target image 620 extends over all the heat generating cells 610*a* to 610*o* in the direction of the y-axis. Therefore, the control unit 160 performs control so that all the heat generating cells 610*a* to 610*o* are caused to generate heat, and performs control so as to print the print target image 620. That is, the control unit 160 performs the control so that a heat generating region corresponding to all the heat generating cells 610*a* to 610*o* is caused to generate heat.

FIG. 10 is a diagram illustrating an arrangement relationship between a plurality of heat generating cells 610*a* to 610*o* and a print target image 650 after correction according to the second specific example of the embodiment.

The print target image 650 is data after correction. The data include a plurality of pieces of character information.

In the case of FIG. 10, the print target image 650 exists only in a heat generating region corresponding to a part of heat generating cells among all the heat generating cells 610*a* to 610*o* in the direction of the y-axis. The above-described part of the heat generating cells are the heat generating cells 610*a* and 610*b*, 610*d* and 610*e*, 610*g* and 610*h*, 610*j* and 610*k*, and 610*m* and 610*n*. Therefore, the control unit 160 performs control so that only the part of the heat generating cells 610*a* and 610*b*, 610*d* and 610*e*, 610*g* and 610*h*, 610*j* and 610*k*, and 610*m* and 610*n* are caused to generate heat, and performs control so as to print the print target image 650. That is, the control unit 160 performs the control so that only the heat generating region corresponding to the part of the heat generating cells 610*a* and 610*b*, 610*d* and 610*e*, 610*g* and 610*h*, 610*j* and 610*k*, and 610*m* and 610*n* is caused to generate heat.

In the example of FIG. 10, different colors are respectively applied to the heat generating cells which are caused to generate heat and the heat generating cells which are not caused to generate heat. The heat generating cells which are caused to generate heat are the heat generating cells 610*a* and 610*b*, 610*d* and 610*e*, 610*g* and 610*h*, 610*j* and 610*k*, and 610*m* and 610*n*. The heat generating cells which are not caused to generate heat are the heat generating cells 610*c*, 610*f*, 610*i*, 6101, and 610*o*.

As described above, in the image forming apparatus 100, the control unit 160 corrects the print target image so that the number of heat generating cells required to generate heat after correction can be reduced as compared with that before correction. In this example, the control unit 160 corrects the print target image so as to minimize the number of heat generating cells required to generate heat. In this example, the control unit 160 converts the print target image into character information, and then corrects the print target image based upon the converted character information. In the image forming apparatus 100, the number of heat generating cells required to generate heat is reduced, thereby making it possible to reduce power required for generating heat of the heat generating cells.

In this example, when the print content exists across the plurality of adjacent heat generating cells, the control unit 160 adjusts the arrangement of the character information so that the print target image is arranged in fewer heat generating cells. Accordingly, in the image forming apparatus 100, it is possible to print the print target image in the minimum heat generating region to the possible extent.

Here, in the example of FIG. 10, the same heat generating pattern is formed for each group of three pieces of the heat generating cells in the order of the arrangement of fifteen pieces of the heat generating cells 610*a* to 610*o*. The heat generating pattern is a pattern in which the first two pieces of the heat generating cells out of three pieces of the heat generating cells are caused to generate heat and the remaining one heat generating cell is not caused to generate heat.

Specifically, the group of the first three pieces of the heat generating cells 610*a* to 610*c* has a pattern in which the first two pieces of the heat generating cells 610*a* and 610*b* are caused to generate heat and the remaining one heat generating cell 610*c* is not caused to generate heat. With respect to the fourth and subsequent heat generating cells 610*d* to 610*o*, the same heat generating pattern of three pieces of the heat generating cells is periodically repeated. The control unit 160 generates the print target image 650 after correction which is adjusted so as to achieve the above-described periodic heat generating pattern. In the print target image 650 after correction, characters exist in a heat generating region corresponding to the first two pieces of the heat generating cells and characters do not exist in a heat generating region corresponding to the remaining one heat generating cell for each group of three pieces of the heat generating cells.

A specific example of printing images of a plurality of sheets 710, 720, and 730 will be described with reference to FIG. 11, FIGS. 12A to 12C, and FIGS. 13A to 13C.

In this example, a case where a heat generating body 750 includes fifteen pieces of the heat generating cells 750*a* to 750*o* is shown.

The same xyz orthogonal coordinate system as that of FIG. 3 is illustrated in each of FIG. 11, FIGS. 12A to 12C, and FIGS. 13A to 13C for convenience of description.

In the example of FIGS. 12A to 12C, and FIGS. 13A to 13C, different colors are respectively applied to the heat generating cells which are caused to generate heat and the heat generating cells which are not caused to generate heat.

Figure 11:
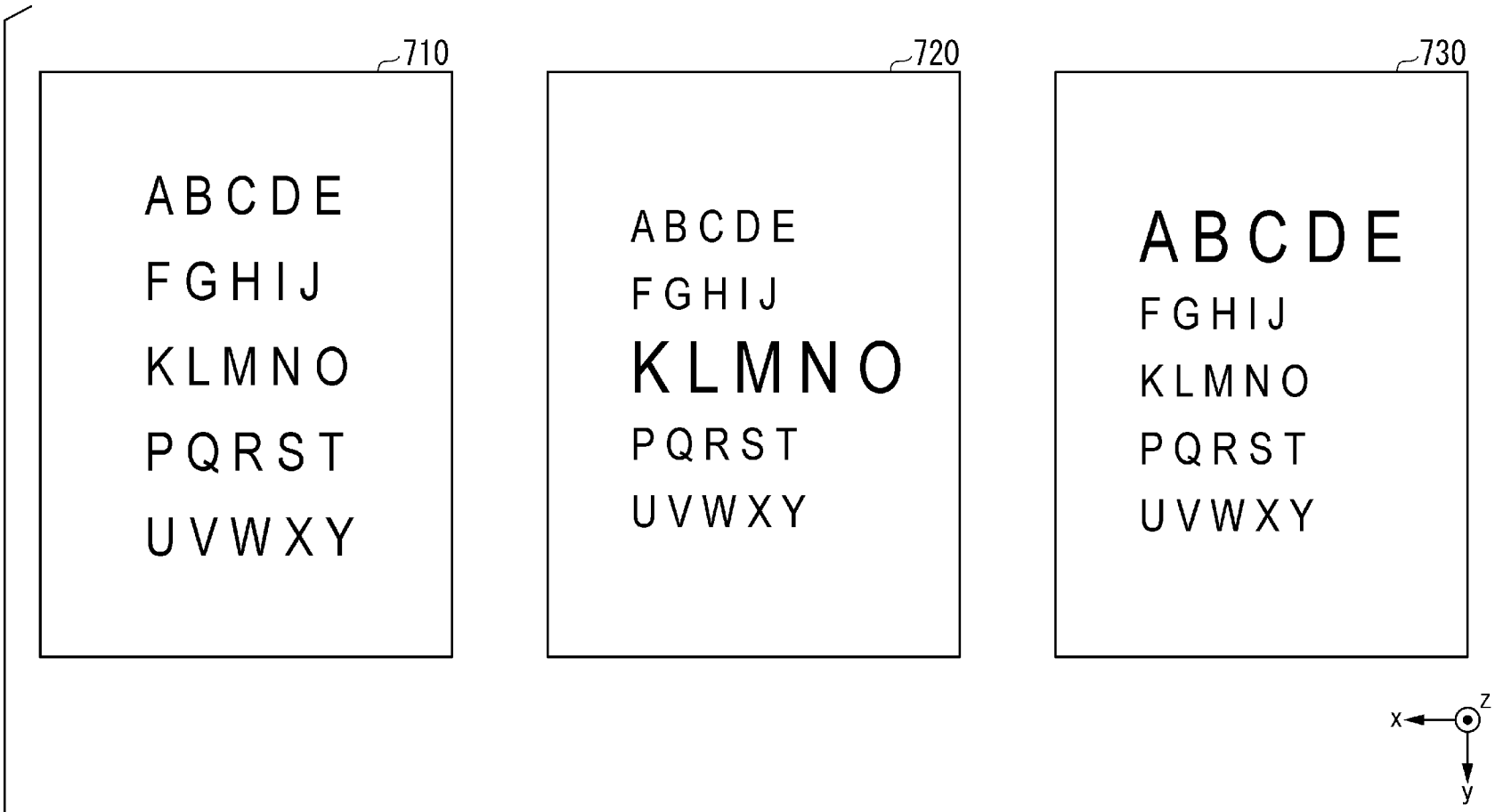
FIG. 11 is a diagram illustrating a plurality of sheets according to a third specific example of the embodiment.

FIG. 11 is a diagram illustrating the plurality of sheets 710, 720, and 730 according to a third specific example of the embodiment.

The sheet 710 is a first page sheet, the sheet 720 is a second page sheet, and the sheet 730 is a third page sheet. Images including characters are formed on the respective sheets 710, 720, and 730. The arrangements of the images are different for each of the sheets 710, 720, and 730.

Figure 12A:
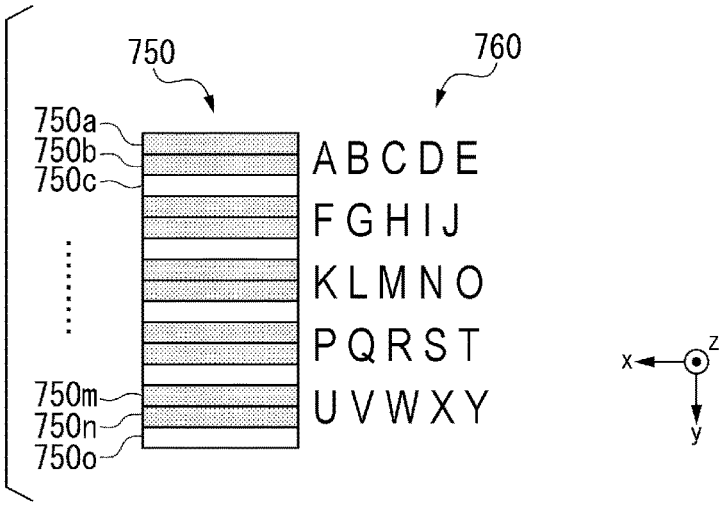
FIG. 12A is a diagram illustrating a heat generating pattern of a first page with respect to a print target image before correction according to the third specific example of the embodiment.

FIG. 12A is a diagram illustrating a heat generating pattern of the first page with respect to the print target image before correction according to the third specific example of the embodiment.

A print target image 760 is data before correction of the first page. The data include a plurality of pieces of character information.

In the example of FIG. 12A, the print target image 760 exists only in a heat generating region corresponding to apart of all the heat generating cells 750*a* to 750*o* in the direction of the y-axis. The above-described part of the heat generating cells are the heat generating cells 750*a* and 750*b*, 750*d* and 750*e*, 750*g* and 750*h*, 750*j* and 750*k*, and 750*m* and 750*n*. Therefore, the control unit 160 performs control so that only the part of the heat generating cells 750*a* and 750*b*, 750*d* and 750*e*, 750*g* and 750*h*, 750*j* and 750*k*, and 750*m* and 750*n* are caused to generate heat, and performs control so as to print the print target image 760.

In the example of FIG. 12A, the same heat generating pattern is formed for each group of three pieces of the heat generating cells in the order of the arrangement of fifteen pieces of the heat generating cells 750*a* to 750*o*. The heat generating pattern is a pattern in which the first two pieces of the heat generating cells out of three pieces of the heat generating cells are caused to generate heat and the remaining one heat generating cell is not caused to generate heat. Such three pieces of the heat generating patterns are repeated.

Figure 12B:
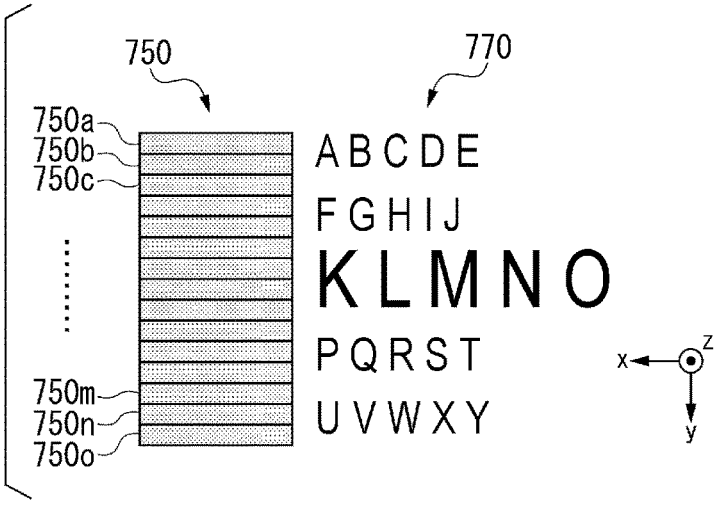
FIG. 12B is a diagram illustrating a heat generating pattern of a second page with respect to the print target image before correction according to the third specific example of the embodiment.

FIG. 12B is a diagram illustrating a heat generating pattern of the second page with respect to the print target image before correction according to the third specific example of the embodiment.

A print target image 770 is data before correction of the second page. The data include a plurality of pieces of character information.

In the case of FIG. 12B, the print target image 770 extends over all the heat generating cells 750*a* to 750*o* in the direction of the y-axis. Therefore, the control unit 160 performs control so that all the heat generating cells 750*a* to 750*o* are caused to generate heat, and performs control so as to print the print target image 770. That is, the control unit 160 performs the control so that a heat generating region corresponding to all the heat generating cells 750*a* to 750*o* is caused to generate heat.

Figure 12C:
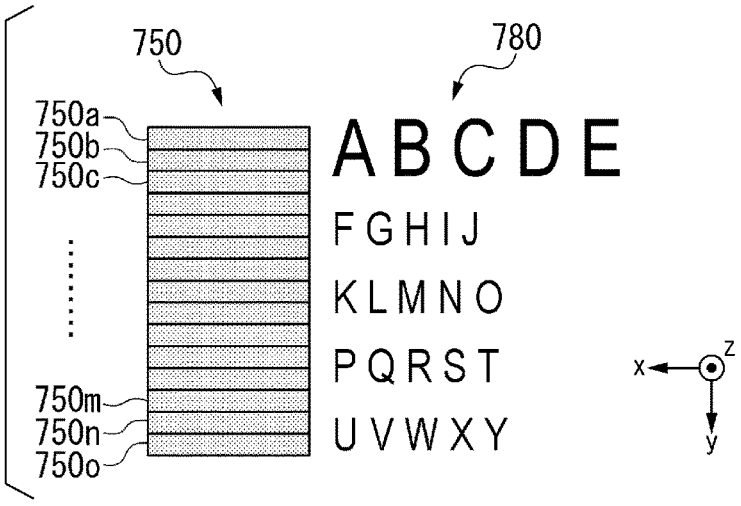
FIG. 12C is a diagram illustrating a heat generating pattern of a third page with respect to the print target image before correction according to the third specific example of the embodiment.

FIG. 12C is a diagram illustrating a heat generating pattern of the third page with respect to the print target image before correction according to the third specific example of the embodiment.

A print target image 780 is data before correction of the third page. The data include a plurality of pieces of character information.

In the case of FIG. 12C, the print target image 780 extends over all the heat generating cells 750*a* to 750*o* in the direction of the y-axis. Therefore, the control unit 160 performs control so that all the heat generating cells 750*a* to 750*o* are caused to generate heat, and performs control so as to print the print target image 780. That is, the control unit 160 performs the control so that a heat generating region corresponding to all the heat generating cells 750*a* to 750*o* is caused to generate heat.

Figure 13A:
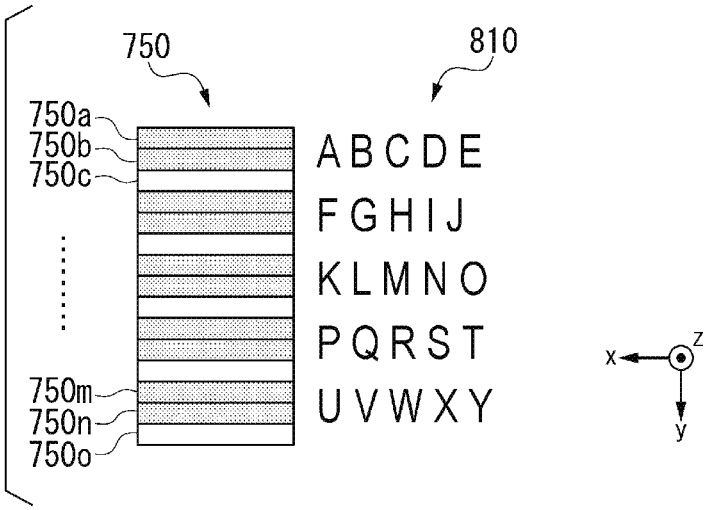
FIG. 13A is a diagram illustrating a heat generating pattern of a first page with respect to a print target image after correction according to the third specific example of the embodiment.

FIG. 13A is a diagram illustrating a heat generating pattern of the first page with respect to the print target image after correction according to the third specific example of the embodiment.

A print target image 810 is data after correction of the first page. The data include a plurality of pieces of character information.

In this example, with respect to the first page, the control unit 160 uses the data before correction as they are as the data after correction. Therefore, the heat generating pattern of FIG. 13A is the same as that of FIG. 12A.

Figure 13B:
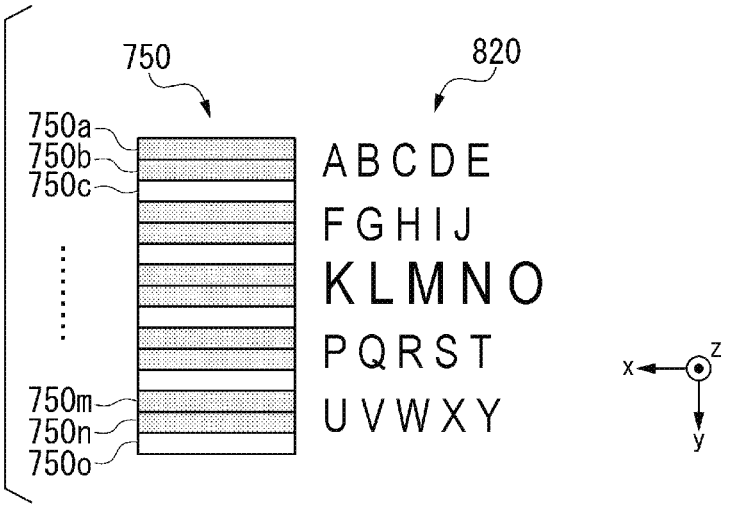
FIG. 13B is a diagram illustrating a heat generating pattern of a second page with respect to the print target image after correction according to the third specific example of the embodiment.

FIG. 13B is a diagram illustrating a heat generating pattern of the second page with respect to the print target image after correction according to the third specific example of the embodiment.

A print target image 820 is data after correction of the second page. The data include a plurality of pieces of character information.

In this example, the control unit 160 corrects the print target image 770 before correction so that the heat generating pattern of the second page becomes the same as the heat generating pattern of the first page, thereby generating the print target image 820 after correction.

Figure 13C:
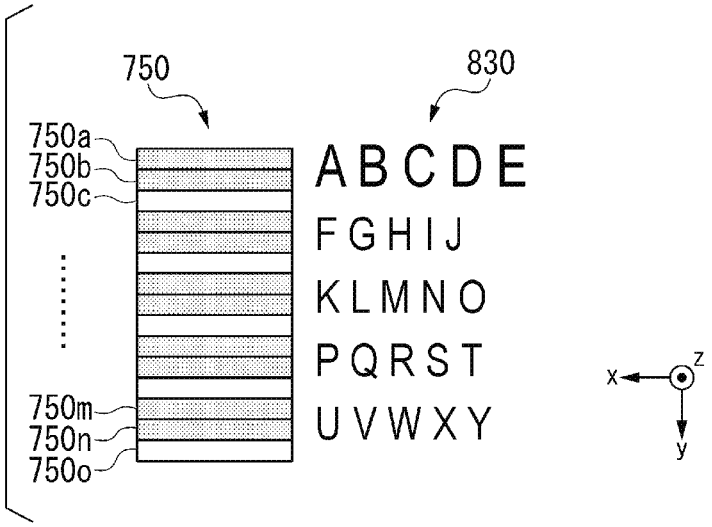
FIG. 13C is a diagram illustrating a heat generating pattern of a third page with respect to the print target image after correction according to the third specific example of the embodiment.

FIG. 13C is a diagram illustrating a heat generating pattern of the third page with respect to the print target image after correction according to the third specific example of the embodiment.

A print target image 830 is data after correction of the third page. The data include a plurality of pieces of character information.

In this example, the control unit 160 corrects the print target image 780 so that the heat generating pattern of the third page is the same as the heat generating pattern of the first page, thereby generating the print target image 830 after correction.

As described above, the control unit 160 corrects the print target images 760, 770, and 780 across a plurality of pages, so that the number of heat generating cells required to generate heat after correction can be reduced as compared with that before correction.

Further, in this example, the control unit 160 corrects the print target images 760, 770, and 780 so that the heat generating patterns thereof are the same for all the pages. Accordingly, in the image forming apparatus 100, the same heating pattern can be used for all the pages, thereby improving efficiency.

In this example, when the character information continues over a plurality of pages, the control unit 160 determines an optimum layout in consideration of the character information up to several pages ahead. For example, when a size of a character is changed for each title or paragraph, the control unit 160 corrects one or more of a size of the character, a space between the characters, and a line space between the characters with respect to the changed portion or an arbitrary partial portion. Thus, the control unit 160 adjusts the layout of the character information so that the plurality of pages can be printed with the same heat generating pattern.

A specific example of printing an image of a sheet will be described with reference to FIGS. 14 and 15.

Figure 14:
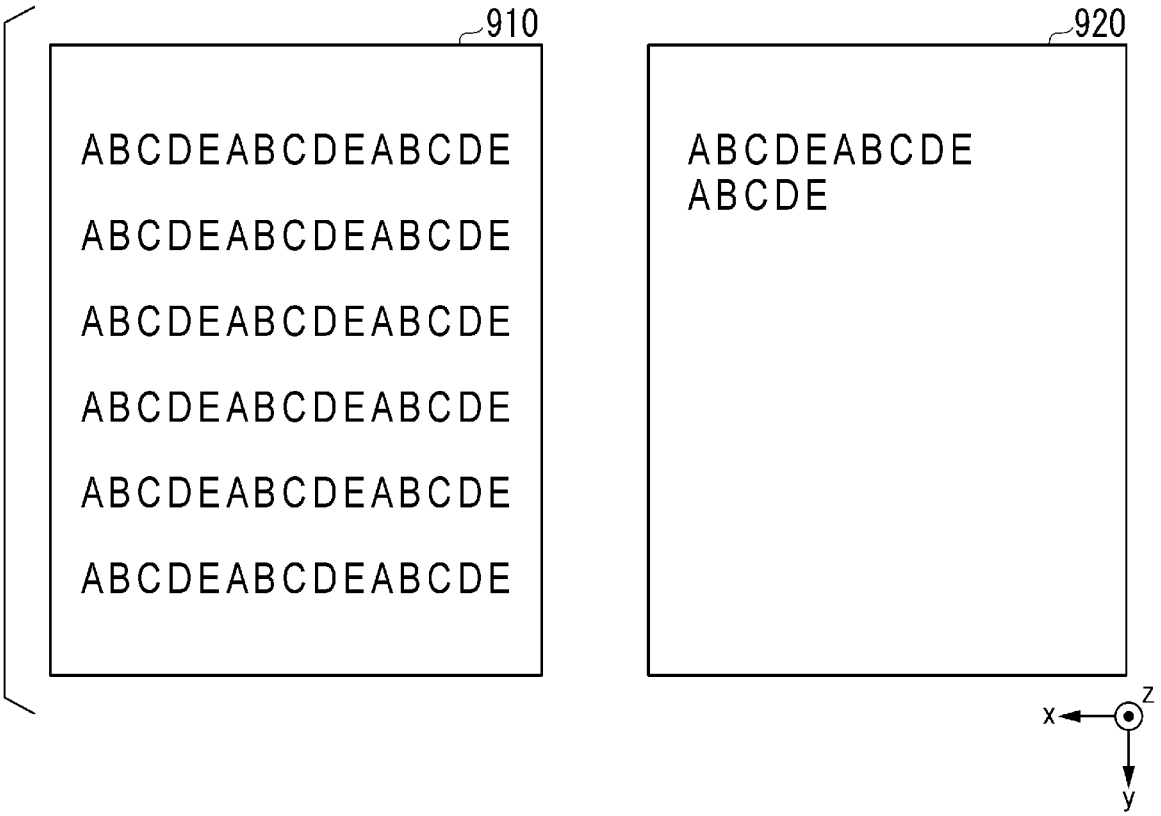
FIG. 14 is a diagram illustrating an image of a sheet of two pages after correction with respect to a print target image after correction according to a fourth specific example of the embodiment.
Figure 15:
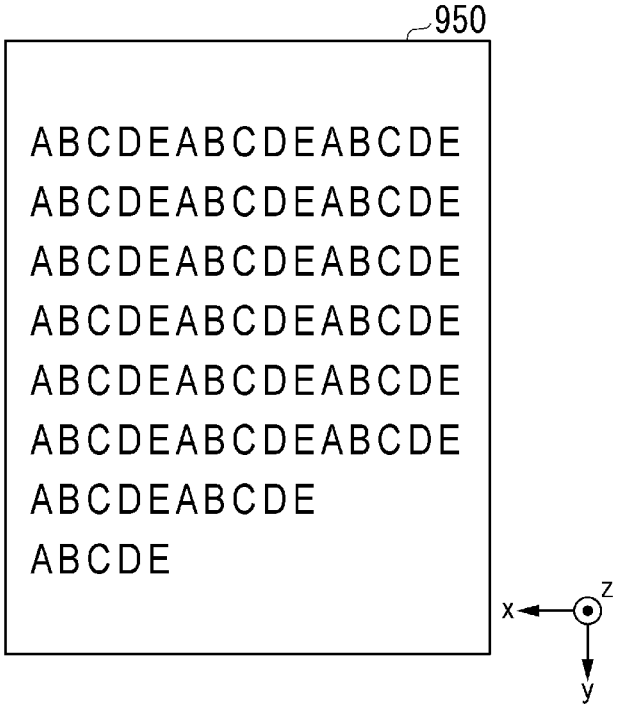
FIG. 15 is a diagram illustrating an image of a sheet of one page after correction with respect to the print target image after correction according to the fourth specific example of the embodiment.

Each of FIGS. 14 and 15 illustrates the same xyz orthogonal coordinate system as that of FIG. 3 for convenience of description.

FIG. 14 is a diagram illustrating images of sheets 910 and 920 of two pages after correction with respect to a print target image before correction according to a fourth specific example of the embodiment.

In this example, on the sheet 910 of the first page, an image is formed in the majority of the whole region from the upper side of the sheet 910 to the lower side thereof. On the other hand, on the sheet 920 of the second page, an image is formed only at a part of the upper side of the sheet 920. These images are formed of characters.

FIG. 15 is a diagram illustrating an image of a sheet 950 of one page after correction with respect to the print target image after correction according to the fourth specific example of the embodiment.

In this example, the control unit 160 adds the character included in the image of the sheet 920 of the second page before correction to the character included in the image of the sheet 910 of the first page before correction. Accordingly, the control unit 160 generates the print target image of one page after correction including all the characters included in the images of the sheets 910 and 920 of two pages before correction. Next, the control unit 160 performs control so that the print target image after correction is printed on the sheet 950.

Further, in this example, the images of the sheets 910 and 920 of two pages before correction are images before correction. Then, in this example, the print target image of one page after correction is the image after correction.

As described above, in this example, the control unit 160 corrects the print target image so that the number of sheets to be printed after correction is reduced as compared with that before correction. As a result, in this example, the image forming apparatus 100 can shorten the time for causing the heat generating cell of the fixing device 30 to generate heat after correction as compared with the time before correction. Further, in this example, in the image forming apparatus 100, the control unit 160 can reduce the number of heat generating cells required to generate heat in the image of one page after correction as compared with the images of two pages before correction. Further, in this example, when the same heat generating cell is caused to generate heat on the first page and the second page, the number of heat generating cells which are caused to generate heat is substantially two pieces with respect to the heat generating cell.

As described above, in this example, when there is a page having many blanks in the print target image among the plurality of pages, the control unit 160 combines the image of the aforementioned page with an image of another adjacent page. Thus, in the image forming apparatus 100, it is possible to realize optimization of the heat generating time and optimization of the number of sheets to be printed.

Further, instead of the blank, it may be referred to as a marginal space.

A specific example of printing an image of a sheet will be described with reference to FIGS. 16 and 17.

In this example, a case in which a heat generating body 1010 includes fifteen pieces of heat generating cells 1010*a* to 1010*o*.

Figure 16:
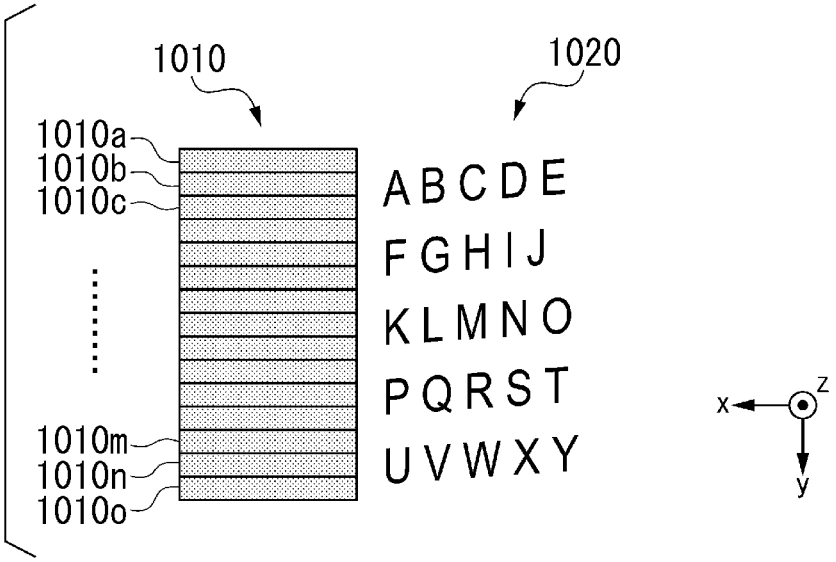
FIG. 16 is a diagram illustrating a heat generating pattern with respect to a print target image before correction according to a fifth specific example of the embodiment.
Figure 17:
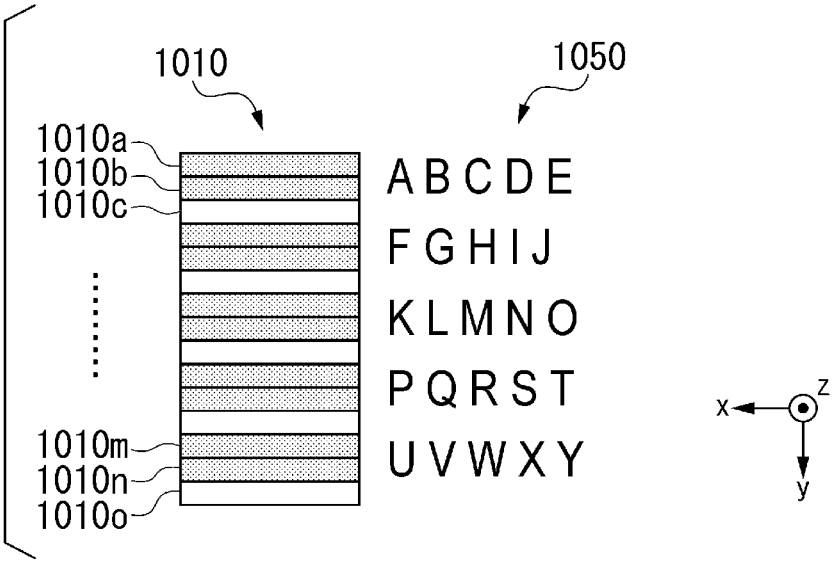
FIG. 17 is a diagram illustrating a heat generating pattern with respect to a print target image after correction according to the fifth specific example of the embodiment.

Each of FIGS. 16 and 17 illustrates the same xyz orthogonal coordinate system as that of FIG. 3 for convenience of description.

In the examples of FIGS. 16 and 17, different colors are respectively applied to the heat generating cells which are caused to generate heat and the heat generating cells which are not caused to generate heat.

FIG. 16 is a diagram illustrating a heat generating pattern with respect to a print target image 1020 before correction according to a fifth specific example of the embodiment.

The print target image 1020 is data before correction. The data include a plurality of pieces of character information.

In the example of FIG. 16, character strings of a plurality of lines included in the print target image 1020 obliquely deviate in the direction parallel to the x-axis which should be the direction of the short side of the sheet. As an example, when an original document to be printed is scanned, the above-described deviation can be generated by obliquely placing the original document rather than appropriately placing it. Further, as another example, the above-described deviation can be generated by a fact that an image of the original document to be printed originally deviates in the oblique direction.

Since the above-described deviation exists, the print target image 1020 extends over all the heat generating cells 1010*a* to 1010*o*. Therefore, the control unit 160 performs control so that all the heat generating cells 1010*a* to 1010*o* are caused to generate heat, and performs control so as to print the print target image 1020. That is, the control unit 160 performs the control so that a heat generating region corresponding to all the heat generating cells 1010*a* to 1010*o* is caused to generate heat.

FIG. 17 is a diagram illustrating a heat generating pattern of a print target image 1050 after correction according to the fifth specific example of the embodiment.

In this example, the control unit 160 generates the print target image 1050 in which the deviation in the direction of the character strings of the plurality of lines in the print target image 1020 before correction illustrated in FIG. 16 is corrected. In the print target image 1050 after correction, the character strings of the plurality of lines are arranged in a direction parallel to the x-axis which should be the direction of the short side of the sheet.

In the case of FIG. 17, the print target image 1050 exists only in a heat generating region corresponding to a part of all the heat generating cells 1010*a* to 1010*o* in the direction of the y-axis. The above-described part of the heat generating cells are the heat generating cells 1010*a* and 1010*b*, 1010*d* and 1010*e*, 1010*g* and 1010*h*, 1010*j* and 1010*k*, and 1010*m* and 1010*n*. Therefore, the control unit 160 performs control so that only the part of the heat generating cells 1010*a* and 1010*b*, 1010*d* and 1010*e*, 1010*g* and 1010*h*, 1010*j* and 1010*k*, and 1010*m* and 1010*n* are caused to generate heat. Accordingly, the control unit 160 performs control so as to print the print target image 1050.

As described above, the control unit 160 corrects the print target image so that the number of heat generating cells required to generate heat after correction can be reduced as compared with that before correction. In this example, the control unit 160 corrects the print target image so as to minimize the number of heat generating cells required to generate heat. In this example, the control unit 160 converts the print target image into character information, and corrects the print target image based upon the converted character information. In the image forming apparatus 100, the number of heat generating cells required to generate heat is reduced, thereby making it possible to reduce the power required for causing the heat generating cells to generate heat.

As in this example, in the image forming apparatus 100, an image obtained by scanning may be data read in a state of being inclined to a frame of the sheet. Next, when all the character strings of one line along the advancing direction of the sheet are inclined from the advancing direction thereof, the control unit 160 may be required to generate heat up to a region where heat generation is not required originally. On the other hand, in this example, the control unit 160 corrects the inclination of the character strings inclined as described above so as to minimize the heat generating region.

As described above, in the image forming apparatus 100, there may be a portion where image parts to be printed exist and a portion where the image parts to be printed do not exist and thus a blank exists in the print target image. Therefore, the image forming apparatus 100 corrects the print target image so as to reduce the number of heat generating cells which are caused to generate heat, based upon the arrangement of the print target image and the arrangement of the plurality of heat generating cells of the fixing device 30. As a result, in the image forming apparatus 100, power saving can be achieved with respect to the heat generation of the heat generating body 45 by the heater 40 of the fixing device 30.

For example, in the image forming apparatus 100, when print contents extend over two or more adjacent heat generating cells, the print contents are corrected so as to reduce the number of heat generating cells over which the print contents extend.

For example, in the image forming apparatus 100, when a width of a blank portion is narrower than a width of the heat generating cell of one heat generating cell, the print contents are corrected so that the width of the blank portion becomes larger than the width of the heat generating cell of one heat generating cell and thus the number of heat generating cells over which the print contents extend is reduced.

For example, when copying the original document, the image forming apparatus 100 extracts the character information from the copied image by executing the OCR processing. Next, the image forming apparatus 100 adjusts the arrangement of the extracted character information based upon information on specifying the arrangement of the plurality of heat generating cells. Thus, the image forming apparatus 100 can perform more appropriate heat generating control after correction than before correction. Accordingly, the image forming apparatus 100 can save energy.

In the image forming apparatus 100, when a character included in an image of print data is recognized as the character information, a size of the character, a space between the characters, a line space between the characters can be adjusted. Further, in the image forming apparatus 100, the arrangement of the character information can be adjusted so as not to significantly affect a layout configuration of the print data.

As a desirable example, the control unit 160 corrects the print target image so that the line space of the character information to be printed becomes larger than the width of one heat generating cell. Accordingly, it is not necessary to cause one or more heat generating cells corresponding to the line space of the character information to be printed to generate heat.

As a desirable example, the control unit 160 corrects the print target image so that the heat generating pattern of each group of a predetermined number of heat generating cells is periodically repeated in the order of the arrangement of the plurality of heat generating cells.

For example, in the image forming apparatus 100, when the heat generating body 45 of the fixing device 30 includes a plurality of heat generating cells, the arrangement of the print target image and the arrangement of the plurality of heat generating cells may not match each other. In the embodiment, in consideration of the above-described point, the image forming apparatus 100 corrects the print target image based upon the arrangements thereof.

For example, in the flow illustrated in FIG. 5, one or both of the processing of ACT 102 and ACT 103 may not be provided.

For example, in the flow illustrated in FIG. 5, the processing of ACT 109 and the processing of ACT 110 may not be provided.

In the image forming apparatus 100 of an embodiment, the control unit 160 performs the OCR processing on the print target image, converts the image into the character information, and then adjusts the arrangement of the characters, thereby correcting the print target image. The mode of correcting the print target image is not limited thereto.

As another example, the control unit 160 may correct the print target image as it is without converting the image into the character information. Specifically, the control unit 160 may correct the print target image by changing the arrangement of an arbitrary image portion among the images represented on the sheet. The image portion may be a portion included in a predetermined region set on the sheet in the image forming apparatus 100. Further, when the image represented on the sheet is formed of a plurality of image information, the image portion may be one image information or a collection of one or more image information.

In the embodiment, the image information represents information of a portion identified as an image such as a specific graphic or photograph. In this case, the OCR processing in the embodiment may not be performed.

As a specific example, when the print target image has a plurality of image information to be identified as the image such as the graphic, the size of any image information or the space between any two image information may be adjusted in the image forming apparatus 100.

Further, data of a print target image originally having the character information may be used as a print target. For example, such data may be data generated by an application including a function of generating a document. Further, such data may be data generated by an application including a function of generating a graphic. In these cases, the image forming apparatus 100 is not required to perform the OCR processing in the embodiment.

Further, the print target image may include two or more types of different types of information such as character information and graphic information. In this case, in the image forming apparatus 100, the control unit 160 may adjust the arrangements of the two or more types of information.

When the advancing direction of the sheet is rotated by 90°, which is different from the example of the embodiment, the control unit 160 of the image forming apparatus 100 may perform the following processing. That is, the control unit 160 rotates the data of the print target image after scanning by 90°. Then, the control unit 160 corrects an image representing the content of data of the print target image which is rotated by 90°. Thereafter, the control unit 160 performs control so as to print the image of the data after correction. In this case, the direction of the sheet as a result of printing is rotated by 90° with respect to the direction of the inputted sheet.

Here, if the aforementioned case is described using the example of FIG. 6, the case in which the advancing direction of the sheet is rotated by 90° is a case where the direction of the long side of the sheet 510 is parallel to the x-axis which is the advancing direction.

Further, when the advancing direction of the sheet is rotated by 90°, which is different from the example of the embodiment, the control unit 160 of the image forming apparatus 100 may perform the following processing. That is, the control unit 160 processes the data of the print target image after scanning as they are without rotating the data. Specifically, the control unit 160 corrects the data of the print target image so as not to use a predetermined number of heat generating cells from one end and a predetermined number of heat generating cells from the other end with respect to the arrangement of the plurality of heat generating cells. That is, the control unit 160 performs correction to shift the character string of each line to the center so that the character does not exist within a predetermined distance from one end or opposite end parts out of the opposite end parts of the character string described in parallel to the direction of the y-axis on the sheet.

In the embodiment, the fixing device 30 including the film unit **30*h* and the pressure roller 30*p*** is used, but is not limited thereto. For example, a fixing device including a heating roller and a pressure roller may be used.

Hereinafter, configuration examples of the image forming apparatus 100, an image forming method, and a non-transitory recording medium according to the embodiment will be described.

As one aspect, the image forming apparatus 100 includes the fixing device 30 and the control unit 160.

The fixing device 30 forms an image represented by print data on an image forming medium by causing a part or all of the plurality of heat generating cells to generate heat, and by fixing a developer image corresponding to the print data on the surface of the image forming medium. In the embodiment, the plurality of heat generating cells are provided in the heat generating body 45. In the embodiment, the image forming medium is a sheet, but is not limited thereto.

The control unit 160 corrects the image data before correction so as to reduce the number of heat generating cells which are caused to generate heat among the plurality of heat generating cells based on the arrangement of the image represented by the image data before correction and the arrangement of the plurality of heat generating cells, and uses image data after correction obtained by correcting the image data before correction as the print data.

Accordingly, in the image forming apparatus 100, it is possible to achieve power saving.

As one aspect, in the image forming apparatus 100, the control unit 160 reads character information from the image data before correction, and adjusts the arrangement of the character information, thereby correcting the image data before correction.

Thus, in the image forming apparatus 100, since the arrangement of the character information is adjusted, the adjustment can be easily performed.

As one aspect, in the image forming apparatus 100, the control unit 160 corrects the image data before correction by adjusting one or more of the size of the character, the space between the characters, and the line space between the characters with respect to the character information.

Accordingly, in the image forming apparatus 100, the adjustment can be easily performed by adjusting the size of the character.

As one aspect, in the image forming apparatus 100, the control unit 160 corrects the image data before correction so that at least one blank portion in the image of the image data before correction becomes equal to or larger than the width of one heat generating cell.

Accordingly, in the image forming apparatus 100, the heat generation of at least one heat generating cell can become unnecessary by the blank portion formed to be equal to or larger than the width of one heat generating cell.

As one aspect, in the image forming apparatus 100, the control unit 160 corrects the image data before correction so that the same heat generating pattern is repeated for each of a predetermined number of heat generating cells smaller than the plurality of heat generating cells in the arrangement of the plurality of heat generating cells.

Therefore, in the image forming apparatus 100, the same heat generating pattern is repeated in the arrangement of the plurality of heat generating cells, thereby efficiently improving the control of the heat generation.

As one aspect, in the image forming apparatus 100, the control unit 160 corrects the image data before correction so that a plurality of continuous pages in the image data before correction have the same heat generating pattern in the arrangement of the plurality of heat generating cells.

Accordingly, in the image forming apparatus 100, the control of heat generation can be made efficient by repeating the same heat generating pattern with respect to the plurality of continuous pages.

Here, the number of the plurality of continuous pages may be any number of two or more pages.

As one aspect, in the image forming apparatus 100, the control unit 160 corrects the image data before correction so as to add an image of a second page to an image of a first page in the image data before correction.

Accordingly, in the image forming apparatus 100, the number of pages to be printed can be reduced by adding the image of the second page to the image of the first page.

Further, in addition to one aspect of combining the images of two pages, another aspect of combining the images of three or more pages may be used.

As one aspect, in the image forming apparatus 100, the control unit 160 corrects the image data before correction so as to eliminate an inclination when the image of the image data before correction has the inclination from the direction perpendicular to the arrangement of the plurality of heat generating cells.

Therefore, in the image forming apparatus 100, when an image has an inclination with respect to an image forming medium in scanning, the inclination can be eliminated, thereby making it possible to reduce the number of heat generating cells required to generate heat.

As one aspect, the image forming method performed in the image forming apparatus 100 can be provided.

That is, the image forming method includes, by the image forming apparatus 100, correcting the image data before correction so as to reduce the number of heat generating cells which are caused to generate heat among the plurality of heat generating cells based upon the arrangement of the image represented by the image data before correction and the arrangement of the plurality of heat generating cells.

The image forming method includes, by the image forming apparatus 100, using the image data after correction obtained by correcting the image data before correction as the print data.

Accordingly, in the image forming method, it is possible to achieve power saving.

As one aspect, the non-transitory recording medium can be provided.

That is, the non-transitory recording medium stores a program for causing a predetermined computer to execute predetermined steps.

The predetermined computer generates the print data to be printed by a predetermined image forming apparatus. The predetermined image forming apparatus includes a fixing device that forms an image represented by the print data on an image forming medium by causing a part or all of the plurality of heat generating cells to generate heat, and by fixing a developer image corresponding to the print data on the surface of the image forming medium.

The program causes the computer to acquire the image data before correction. Further, the program causes the computer to correct the image data before correction so as to reduce the number of heat generating cells which are caused to generate heat among the plurality of heat generating cells based upon the arrangement of the image represented by the image data before correction and the arrangement of the plurality of heat generating cells. Further, the program causes the computer to print, by the image forming apparatus, the print data by using the image data after correction obtained by correcting the image data before correction as the print data.

Accordingly, in the non-transitory recording medium, it is possible to achieve power saving.

In the embodiment, the predetermined computer corresponds to a functional part that executes the processing of the above-described steps by the control unit 160. Alternatively, the predetermined computer may include such a functional part and may be considered to be any configuration part configured with hardware and programs.

Second Embodiment

Figure 18:
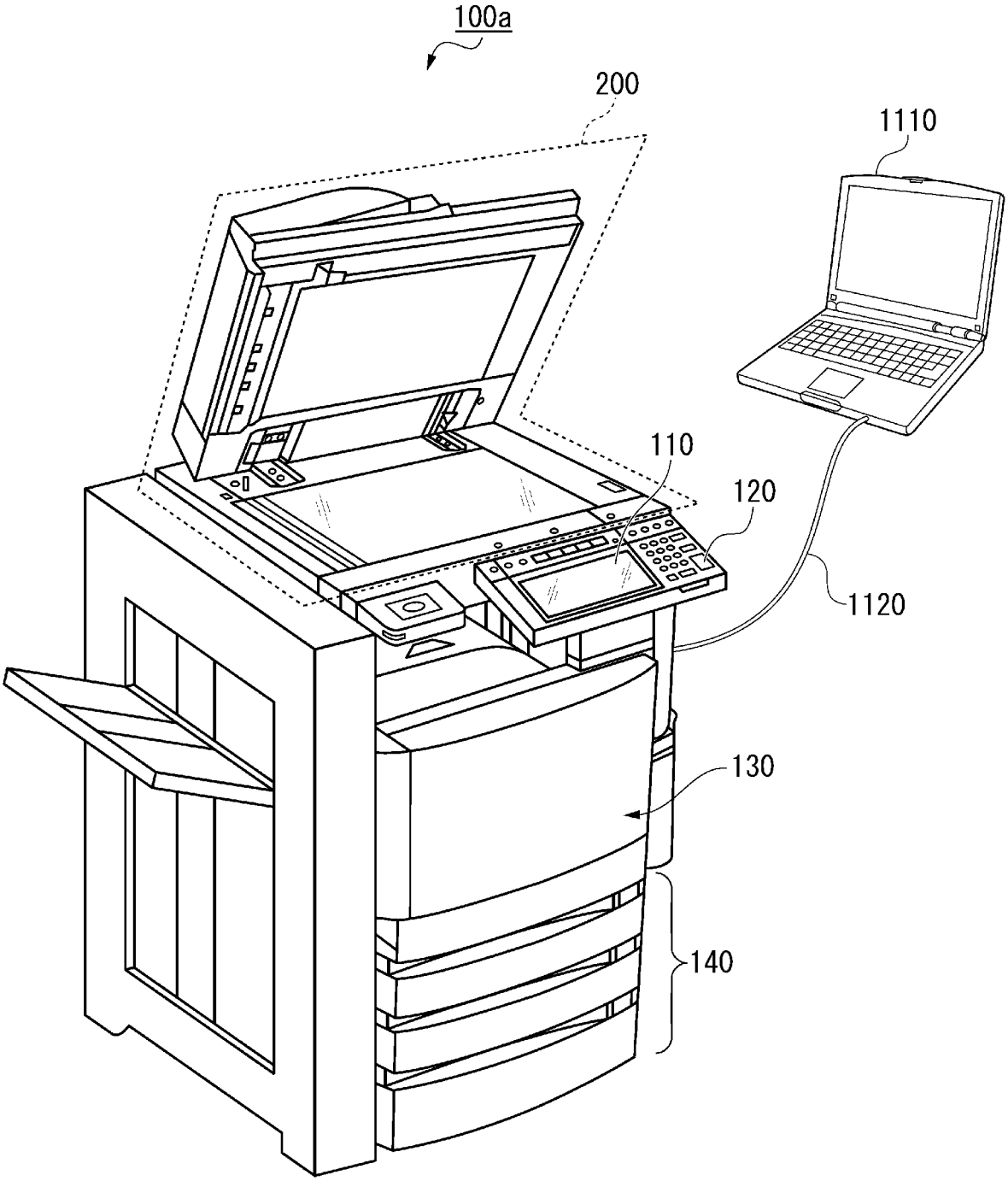
FIG. 18 is an external view illustrating an example of an overall configuration of an image forming system of an embodiment.
Figure 19:
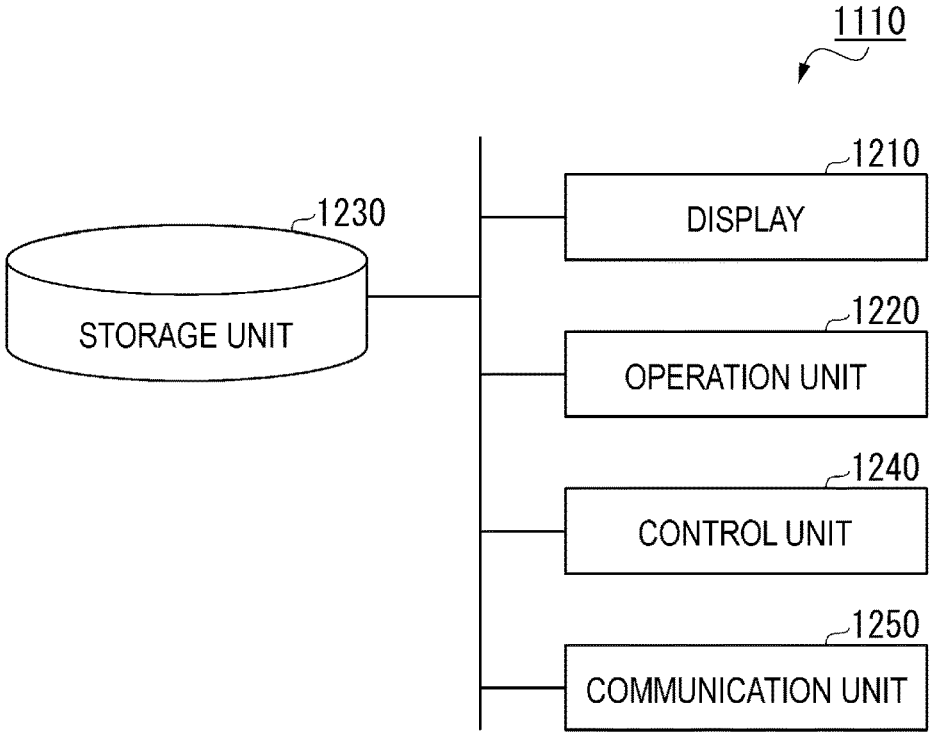
FIG. 19 is a hardware block diagram of an information processing apparatus of an embodiment.
Figure 20:
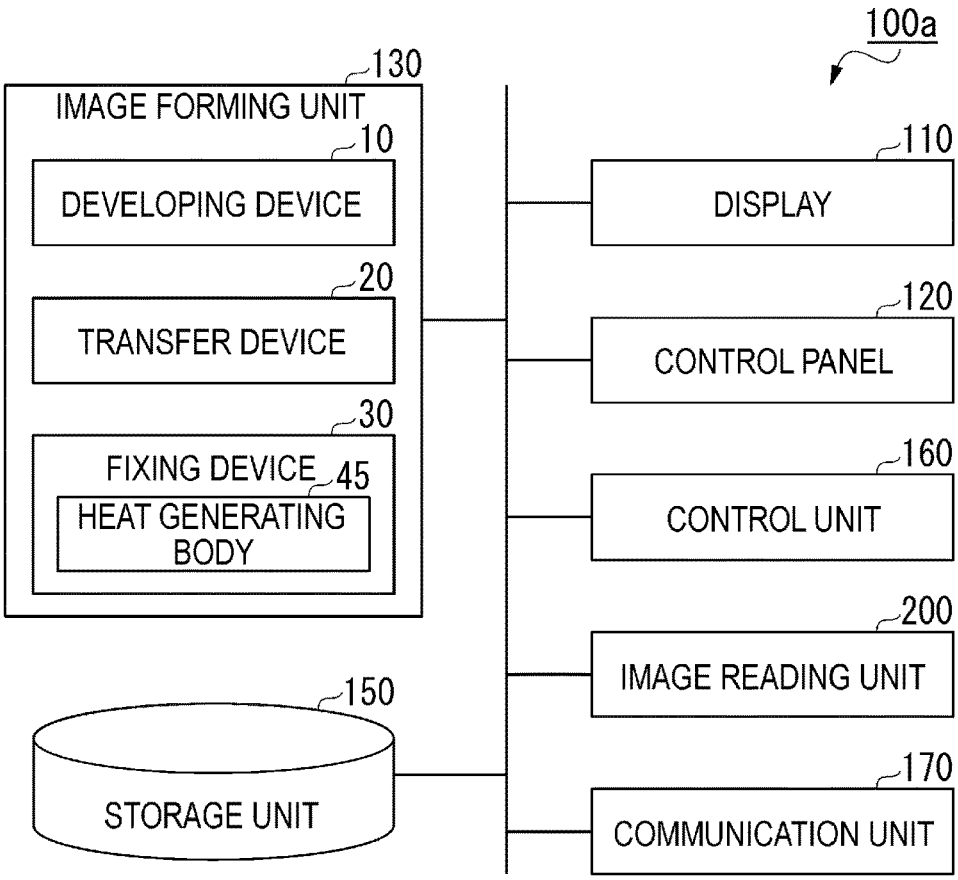
FIG. 20 is a hardware block diagram of an image forming apparatus of an embodiment.

FIG. 18 is an external view illustrating an example of an overall configuration of an image forming system of an embodiment. FIG. 19 is a hardware block diagram of an information processing apparatus 1110 of an embodiment. FIG. 20 is a hardware block diagram of an image forming apparatus 100*a* of an embodiment.

The image forming system includes the information processing apparatus 1110, the image forming apparatus 100*a*, and a cable 1120 for connecting the information processing apparatus 1110 and the image forming apparatus 100*a*. The information processing apparatus 1110 and the image forming apparatus 100*a* communicate with each other via the cable 1120.

For example, the information processing apparatus 1110 is a computer.

The information processing apparatus 1110 includes a display 1210, an operation unit 1220, a storage unit 1230, a control unit 1240, and a communication unit 1250.

The display 1210 is an image display apparatus such as a liquid crystal display and an organic EL display. The display 1210 displays various information related to the information processing apparatus 1110.

The operation unit 1220 includes a keyboard and a mouse. The operation unit 1220 receives an operation of a user. The operation unit 1220 outputs a signal corresponding to the operation performed by the user to the control unit 1240. Further, the display 1210 and the operation unit 1220 may be configured as an integrated touch panel.

The storage unit 1230 is configured by using a storage apparatus such as a magnetic hard disk apparatus or a semiconductor storage apparatus. The storage unit 1230 stores data required when the information processing apparatus 1110 operates.

The control unit 1240 is configured by using a processor such as a CPU and a memory. The control unit 1240 reads and executes a program stored in advance in the storage unit 1230. The control unit 1240 controls the operation of each device provided in the information processing apparatus 1110.

The control unit 1240 has a driver function of controlling printing performed by the image forming apparatus 100*a*.

The communication unit 1250 communicates with the image forming apparatus 100*a*. In the embodiment, the communication unit 1250 communicates with the image forming apparatus 100*a* via the cable 1120.

As another example, the communication unit 1250 may communicate with the image forming apparatus 100*a* by wireless communication. In this case, the information processing apparatus 1110 may be a portable wireless terminal apparatus such as a smart phone.

The image forming apparatus 100*a* includes the display 110, the control panel 120, the image forming unit 130, the storage unit 150, the control unit 160, the image reading unit 200, and a communication unit 170. Here, the display 110, the control panel 120, the image forming unit 130, the storage unit 150, the control unit 160, and the image reading unit 200 are the same as those illustrated in FIG. 2. In FIG. 20, each of these parts is denoted by the same reference sign as that of FIG. 2. In this example, however, the function of the control unit 160 can be different from that of the case of FIG. 2.

The communication unit 170 communicates with the information processing apparatus 1110. In the embodiment, the communication unit 170 communicates with the information processing apparatus 1110 via the cable 1120.

As another example, the communication unit 170 may communicate with the information processing apparatus 1110 by wireless communication.

In this example, in the information processing apparatus 1110, the control unit 1240 generates data for printing. Further, in the information processing apparatus 1110, the control unit 1240 performs control so as to transmit the generated data for printing to the image forming apparatus 100*a*. The image forming apparatus 100*a* receives the data for printing transmitted from the information processing apparatus 1110. Then, in the image forming apparatus 100*a*, the control unit 160 performs control so as to print the content of the received data for printing.

In the image forming system, the control unit 1240 performs processing of correcting a print target image in the information processing apparatus 1110. Specifically, the control unit 1240 corrects the print target image based upon the arrangement of the plurality of heat generating cells provided in the heat generating body 45 of the fixing device 30 of the image forming apparatus 100*a* and the arrangement of the print target image. Then, the control unit 1240 transmits data of the print target image after correction to the image forming apparatus 100*a*.

In this case, the control unit 1240 may also transmit information indicating the number of copies to be printed to the image forming apparatus 100*a*. For example, the number of copies may be received by the control unit 1240 based upon the content of the operation performed on the operation unit 1220 by a user.

In the image forming apparatus 100*a*, the control unit 160 receives the data of the print target image after correction transmitted from the information processing apparatus 1110. Further, when the information indicating the number of copies is also transmitted from the information processing apparatus 1110 to the image forming apparatus 100*a*, the control unit 160 also receives the information. Then, the control unit 160 performs control so as to print the received data of the print target image after correction by using the image forming unit 130. In this case, when receiving the information indicating the number of copies from the information processing apparatus 1110, the control unit 160 performs control so as to perform printing of the number of copies.

Here, the mode in which the control unit 1240 corrects the print target image in the information processing apparatus 1110 is the same as the mode in which the print target image is corrected in the image forming apparatus 100 illustrated in FIG. 1.

As an example, the information processing apparatus 1110 may store predetermined information in advance in the storage unit 1230. The information is information on specifying the arrangement of the plurality of heat generating cells provided in the heat generating body 45 of the fixing device 30 of the image forming apparatus 100*a*. In this case, the control unit 1240 reads and uses the information stored in advance in the storage unit 1230.

As another example, in the information processing apparatus 1110, the control unit 1240 may receive the predetermined information from the image forming apparatus 100*a*. The information is information on specifying the arrangement of the plurality of heat generating cells provided in the heat generating body 45 of the fixing device 30 of the image forming apparatus 100*a*.

One example of a flow of an operation performed in the image forming system will be described with reference to FIG. 5.

In this example, first, the control unit 1240 acquires data to be printed in the information processing apparatus 1110.

As an example, in the information processing apparatus 1110, the data to be printed may be stored in advance in the storage unit 1230. In this case, the control unit 1240 reads and uses the data, stored in the storage unit 1230, to be printed.

As another example, in the information processing apparatus 1110, the data to be printed may be inputted to the information processing apparatus 1110 from the outside of the information processing apparatus 1110 by a user.

For example, the data to be printed may be transmitted from the image forming apparatus 100*a* to the information processing apparatus 1110. The information processing apparatus 1110 receives the data, transmitted from the image forming apparatus 100*a*, to be printed. In this case, the image forming apparatus 100*a* acquires the data to be printed by scanning or input from the outside.

In this example, the processing of ACT 101 of FIG. 5 is replaced with the processing in which the control unit 1240 acquires the data to be printed in the information processing apparatus 1110. In this example, the processing of ACT 102 to ACT 105 and the processing of ACT 107 to ACT 110 of FIG. 5 are performed in the information processing apparatus 1110.

Further, in this example, the processing of ACT 106 and the processing of ACT 111 and ACT 112 of FIG. 5 are performed in the image forming apparatus 100*a*.

Here, in the information processing apparatus 1110, the control unit 1240 may display information such as a predetermined message on the display 1210. For example, the predetermined message may be stored in advance in the storage unit 1230. In this case, the control unit 1240 reads and uses the message stored in the storage unit 1230.

As another example, the information such as the message may be transmitted from the image forming apparatus 100*a* to the information processing apparatus 1110. In this case, the information processing apparatus 1110 receives the information such as the message transmitted from the image forming apparatus 100*a*. The control unit 1240 uses the received information.

As described above, in the image forming system, the print target image is corrected in the information processing apparatus 1110, and the print target image after correction is printed in the image forming apparatus 100*a*. At this time, in the information processing apparatus 1110, the control unit 1240 corrects the print target image so that the number of heat generating cells which are caused to generate heat among the plurality of heat generating cells after correction is reduced as compared with that before correction. As a result, in the image forming apparatus 100*a*, power saving can be achieved with respect to the heat generation of the heat generating body 45 by the heater 40 of the fixing device 30.

As one aspect, the information processing apparatus 1110 includes the control unit 1240.

The control unit 1240 performs the following processing based upon the arrangement of the image represented by the image data before correction and the arrangement of the plurality of heat generating cells in the fixing device 30 of the image forming apparatus 100*a*. That is, the control unit 1240 corrects the image data before correction so as to reduce the number of heat generating cells which are caused to generate heat among the plurality of heat generating cells, and uses the image data after correction obtained by correcting the image data before correction as the print data.

Accordingly, in the information processing apparatus 1110, it is possible to achieve the power saving in the image forming apparatus 100*a*.

As one aspect, the non-transitory recording medium can be provided.

That is, the non-transitory recording medium stores a program for causing a predetermined computer to execute predetermined steps.

The predetermined computer generates print data to be printed by a predetermined image forming apparatus. The predetermined image forming apparatus includes a fixing device that forms an image represented by the print data on an image forming medium by causing a part or all of the plurality of heat generating cells to generate heat, and by fixing a developer image corresponding to the print data on the surface of the image forming medium.

The program causes the computer to acquire the image data before correction. Further, the program causes the computer to correct the image data before correction so as to reduce the number of heat generating cells which are caused to generate heat among the plurality of heat generating cells based upon the arrangement of the image represented by the image data before correction and the arrangement of the plurality of heat generating cells. Further, the program causes the computer to print, by the image forming apparatus, the print data by using the image data after correction obtained by correcting the image data before correction as the print data.

Accordingly, in the non-transitory recording medium, it is possible to achieve the power saving.

In the embodiment, the predetermined computer corresponds to a functional part that executes the processing of the steps by the control unit 1240. Alternatively, the predetermined computer may include such a functional part and may be considered to be any configuration part configured with hardware and programs. In the embodiment, the predetermined computer may be considered to be the information processing apparatus 1110.

In this case, a program for realizing functions of the image forming apparatuses 100 and 100*a* or the information processing apparatus 1110 according to the embodiment descried above may be stored in a computer readable recording medium. Then, the functions may be performed by causing a computer system to read and execute the program recorded on the recording medium. The computer system may include hardware such as an operating system (OS) or a peripheral device. The computer readable recording medium may be a portable medium such as a flexible disk, a magneto-optical disk, a ROM (Read Only Memory), a writable non-volatile memory such as a flash memory, and a DVD (Digital Versatile Disc). Further, the computer readable recording medium may be a storage apparatus such as a hard disk incorporated in the computer system.

Further, the computer readable recording medium may be a non-transitory recording medium.

Further, the program may be used to realize a part of the above-described functions. Further, the program may be a so-called differential file (a differential program) that can realize the above-described functions in combination with the program already recorded in the computer system.

The function of any component in any apparatus described above may be realized by a processor. For example, each processing in the embodiment may be realized by a processor operating based upon information such as a program and a computer readable recording medium storing the information such as the program. Here, in the processor, the function of each unit may be realized by individual hardware, or the function of each unit may be realized by integrated hardware. For example, the processor may include hardware, and the hardware may include at least one of a circuit for processing a digital signal and a circuit for processing an analog signal. For example, the processor may be configured using one or more circuit apparatuses mounted on a circuit substrate, or one or both of the one or more circuit elements. An IC (Integrated Circuit) may be used as the circuit apparatus, and a resistor or a capacitor may be used as the circuit element.

Here, the processor may be a CPU. However, the processor is not limited to the CPU, and various processors such as a GPU (Graphics Processing Unit) or a DSP (Digital Signal Processor), and the like may be used. Further, the processor may be a hardware circuit by an ASIC (Application Specific Integrated Circuit). Further, the processor may be configured by a plurality of CPUs, or may be configured by a hardware circuit formed of a plurality of ASICs. Further, the processor may be configured by a combination of the plurality of CPUs and the hardware circuit formed of the plurality of ASICs. Further, the processor may include one or more of an amplifier circuit for processing an analog signal or a filter circuit.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

a fixing device configured to form an image represented by print data on an image forming medium by causing at least one of a plurality of heat generating cells to generate heat, and by fixing a developer image corresponding to the print data on a surface of the image forming medium; and a control component configured to correct image data before correction so as to reduce a number of heat generating cells caused to generate heat among the plurality of heat generating cells based upon an arrangement of an image represented by the image data before correction and an arrangement of the plurality of heat generating cells, and to use image data after correction obtained by correcting the image data before correction as the print data.

2. The apparatus according to claim 1, wherein the control component corrects the image data before correction by reading character information from the image data before correction and by adjusting an arrangement of the character information.

3. The apparatus according to claim 2, wherein the control component corrects the image data before correction by adjusting one or more of a size of a character, a space between characters, and a line space between characters with respect to the character information.

4. The apparatus according to claim 1, wherein the control component corrects the image data before correction so that at least one blank portion in the image of the image data before correction becomes equal to or larger than a width of the at least one heat generating cell.

5. The apparatus according to claim 1, wherein the control component corrects the image data before correction so that a same heat generating pattern is repeated for each of a predetermined number of the heat generating cells smaller than the plurality of heat generating cells in the arrangement of the plurality of heat generating cells.

6. The apparatus according to claim 1, wherein the control component corrects the image data before correction so that a plurality of continuous pages in the image data before correction include the same heat generating pattern in the arrangement of the plurality of heat generating cells.

7. The apparatus according to claim 1, wherein the control component corrects the image data before correction so as to add an image of a second page to an image of a first image in the image data before correction.

8. The apparatus according to claim 1, wherein the control component corrects the image data before correction so as to eliminate an inclination when the image of the image data before correction includes the inclination from a direction perpendicular to the arrangement of the plurality of heat generating cells.

9. An image forming method in an image forming apparatus including a fixing device that forms an image represented by print data on an image forming medium by causing at least one of a plurality of heat generating cells to generate heat, and by fixing a developer image corresponding to the print data on a surface of the image forming medium, comprising:

correcting, by the image forming apparatus, image data before correction so as to reduce a number of heat generating cells caused to generate heat among the plurality of heat generating cells based upon an arrangement of an image represented by the image data before correction and an arrangement of the plurality of heat generating cells; and using, by the image forming apparatus, image data after correction obtained by correcting the image data before correction as the print data.

10. The method according to claim 9, further comprising:

correcting, by the image forming apparatus, the image data before correction by reading character information from the image data before correction and by adjusting an arrangement of the character information.

11. The method according to claim 10, further comprising:

correcting, by the image forming apparatus, the image data before correction by adjusting one or more of a size of a character, a space between characters, and a line space between characters with respect to the character information.

12. The method according to claim 9, further comprising:

correcting, by the image forming apparatus, the image data before correction so that at least one blank portion in the image of the image data before correction becomes equal to or larger than a width of the at least one heat generating cell.

13. The method according to claim 9, further comprising:

correcting, by the image forming apparatus, the image data before correction so that a same heat generating pattern is repeated for each of a predetermined number of the heat generating cells smaller than the plurality of heat generating cells in the arrangement of the plurality of heat generating cells.

14. The method according to claim 9, further comprising:

correcting, by the image forming apparatus, the image data before correction so that a plurality of continuous pages in the image data before correction include the same heat generating pattern in the arrangement of the plurality of heat generating cells.

15. The method according to claim 9, further comprising:

correcting, by the image forming apparatus, the image data before correction by adding an image of a second page to an image of a first image in the image data before correction.

16. The method according to claim 9, further comprising:

correcting, by the image forming apparatus, the image data before correction by eliminating an inclination when the image of the image data before correction includes the inclination from a direction perpendicular to the arrangement of the plurality of heat generating cells.

17. A non-transitory storage medium storing a program for causing a computer, which generates print data to be printed by an image forming apparatus including a fixing device that forms an image represented by the print data on an image forming medium by causing at least one of a plurality of heat generating cells to generate heat and by fixing a developer image corresponding to the print data on a surface of the image forming medium, to:

acquire image data before correction;

correct the image data before correction so as to reduce a number of heat generating cells caused to generate heat among the plurality of heat generating cells based upon an arrangement of an image represented by the image data before correction and an arrangement of the plurality of heat generating cells; and print, by the image forming apparatus, the print data by using image data after correction obtained by correcting the image data before correction as the print data.

18. The non-transitory storage medium according to claim 17, wherein the program further causing the computer to:

correct the image data before correction by reading character information from the image data before correction and by adjusting an arrangement of the character information.

19. The non-transitory storage medium according to claim 18, wherein the program further causing the computer to:

correct the image data before correction by adjusting one or more of a size of a character, a space between characters, and a line space between characters with respect to the character information.

20. The non-transitory storage medium according to claim 17, wherein the program further causing the computer to:

correct the image data before correction so that at least one blank portion in the image of the image data before correction becomes equal to or larger than a width of the at least one heat generating cell.

* * * * *